US008113644B2

(12) United States Patent
Tashiro et al.

(10) Patent No.: US 8,113,644 B2
(45) Date of Patent: Feb. 14, 2012

(54) IMAGE FORMING APPARATUS AND IMAGE FORMING METHOD

(75) Inventors: Kazuya Tashiro, Kanagawa (JP); Yutaka Itoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 782 days.

(21) Appl. No.: 12/236,876

(22) Filed: Sep. 24, 2008

(65) Prior Publication Data

US 2009/0092404 A1 Apr. 9, 2009

(30) Foreign Application Priority Data

Oct. 5, 2007 (JP) ..... 2007-261809
Aug. 12, 2008 (JP) ..... 2008-208136

(51) Int. Cl.
*B65H 7/14* (2006.01)

(52) U.S. Cl. ..... 347/104

(58) Field of Classification Search ..... 347/101, 347/104, 218

See application file for complete search history.

(56) References Cited

U.S. PATENT DOCUMENTS 7,537,331 B2 * 5/2009 Akase et al. ..... 347/101
2007/0236754 A1 10/2007 Tashiro et al.

FOREIGN PATENT DOCUMENTS

| | | | |
|---|---|---|---|
| CN | 101045403 | A | 10/2007 |
| EP | 1 531 055 | A1 | 5/2005 |
| JP | 2003-266828 | | 9/2003 |
| JP | 2005-269124 | | 9/2005 |
| JP | 3731579 | | 10/2005 |
| JP | 3753126 | | 12/2005 |
| JP | 2006-38639 | | 2/2006 |
| JP | 3941680 | | 4/2007 |

* cited by examiner

*Primary Examiner* — Huan Tran

(74) *Attorney, Agent, or Firm* — Oblon, Spivak, McClelland, Maier & Neustadt, L.L.P.

(57) ABSTRACT

A sensor reciprocates in a main scanning direction to detect lateral end portions of a sheet conveyed in a sub-scanning direction. A print head is mounted on a carriage reciprocating in the main scanning direction. A sheet-information acquiring unit acquires sheet information including a type and a size of the sheet. A positional-information storing unit stores positional information on lateral positions of the sheet on the conveying belt, corresponding to the size of the sheet. A control unit controls, when the type of the sheet is a pattern-printed sheet, a printing by the print head based on the positional information corresponding to the size of the sheet.

9 Claims, 28 Drawing Sheets

FIG. 9A

| |
|---|
| A3 SIZE DATA |
| B4 SIZE DATA |
| A4 SIZE DATA |
| A5 SIZE DATA |
| CUSTOM SHEET SIZE DATA |

FIG. 9B

| |
|---|
| SHEET SIZE NAME |
| WIDTH |
| LENGTH |

FIG. 11A

| |
|---|
| STANDARD MARGIN DATA |
| DATA ON MARGIN FOR PATTERN-PRINTED SHEET |

FIG. 11B

| |
|---|
| MARGIN DATA NAME |
| TOP MARGIN |
| BOTTOM MARGIN |
| LEFT MARGIN |
| RIGHT MARGIN |

IMAGE FORMING APPARATUS AND IMAGE FORMING METHOD

CROSS-REFERENCE TO RELATED APPLICATIONS

The present application claims priority to and incorporates by reference the entire contents of Japanese priority document 2007-261809 filed in Japan on Oct. 5, 2007 and Japanese priority document 2008-208136 filed in Japan on Aug. 12, 2008.

BACKGROUND OF THE INVENTION

1. Field of the Invention

The present invention relates to an image forming apparatus and an image forming method.

2. Description of the Related Art

In a typical image forming apparatus employing a serial head system (a printing system in which a printing is performed by moving a carriage including an ink-jet head in the main scanning direction) while conveying a sheet in the sub-scanning direction by sticking the sheet on a surface of a conveying belt by an electrostatic force to print an image on a sheet, a leading end portion of the sheet or lateral end portions of the sheet is detected with a reflection-type photosensor mounted on the carriage, thereby determining a print area of the sheet accurately. Therefore, the image forming apparatus can accurately prints the image on the sheet within the print area, and thus it is possible to prevent the conveying belt from being stained with ink.

If the image forming apparatus fails to print the image on the sheet within the print area, a portion of the image is not printed on the sheet or the image is not printed on a specified area of the sheet, which resulting in a print error.

When a portion of the image is not printed on the sheet, an image corresponding to the portion is printed on the conveying belt, so that the conveying belt is stained with ink. The conveying belt is generally made of a very thin material, so that on a portion of which is stained with the ink, the electrostatic force acting on the sheet is reduced. As a result, the sheet is lifted up from the conveying belt. Consequently, it may cause such problems that a printed image is blurred or the print head is damaged because a surface of the sheet is rubbed against the print head due to a floating of the sheet.

To cope with the problems, for example, Japanese Patent Application Laid-open No. 2006-038639 discloses an end position detecting device. The end position detecting device accurately detects a position of an end portion of a sheet based on data on a reflected light detected by a reflection-type photosensor without being affected by a color variation of a surface of the sheet or a surface roughness of the sheet. The data on the reflected light includes data on a light reflected on a supporting member and data on a light reflected on the sheet supported by the supporting member.

However, for example, when an image is printed on a sheet with a printed pattern (hereinafter, "a pattern-printed sheet"), such as company stationery with a company logo, a detection accuracy of the end position detecting device disclosed in Japanese Patent Application Laid-open No. 2006-038639 becomes inaccurate because a false detection of the photosensor is induced. For example, when a pattern printed on the substantially center of a pattern-printed sheet is detected as an end portion of the pattern-printed sheet, it is not possible to print an image on a specified area of the pattern-printed sheet properly.

SUMMARY OF THE INVENTION

It is an object of the present invention to at least partially solve the problems in the conventional technology.

According to one aspect of the present invention, there is provided an image forming apparatus including a conveying belt that conveys a sheet in a sub-scanning direction; a sensor that reciprocates in a main scanning direction to detect lateral end portions of the sheet; a print head that is mounted on a carriage reciprocating in the main scanning direction; a sheet-information acquiring unit that acquires sheet information including a type and a size of the sheet; a positional-information storing unit that stores therein positional information on lateral positions of the sheet on the conveying belt, corresponding to the size of the sheet; and a control unit that controls, when the type of the sheet is a pattern-printed sheet, a printing by the print head based on the positional information corresponding to the size of the sheet.

Furthermore, according to another aspect of the present invention, there is provided an image forming apparatus including a conveying belt that conveys a sheet in a sub-scanning direction; a sensor that reciprocates in a main scanning direction of the sheet so as to detect a leading end portion of the sheet in the sub-scanning direction; a print head that is mounted on a carriage reciprocating in the main scanning direction; a registration roller that controls the sheet to stop right in front of the conveying belt; a sheet-information acquiring unit that acquires sheet information including a type and a size of the sheet; and a control unit that controls, when the type of the sheet is a pattern-printed sheet, a printing by the print head to start when the pattern-printed sheet is conveyed by a distance corresponding to a conveying distance from the registration roller to the print head.

Moreover, according to still another aspect of the present invention, there is provided an image forming method for an image forming apparatus including a positional-information storing unit that stores therein positional information on lateral positions of a sheet on a conveying belt corresponding to a size of the sheet. The image forming method includes acquiring sheet information including a type and a size of the sheet; conveying the sheet in a sub-scanning direction; detecting lateral end portions of the sheet in a main scanning direction; printing an image on the sheet; and controlling, when the type of the sheet is a pattern-printed sheet, the printing based on positional information corresponding to the size of the sheet.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 9A is a schematic diagram of an example of a sheet-size data table;

FIG. 9B is a schematic diagram of an example of a content of sheet size data stored in the sheet-size data table shown in FIG. 9A;

FIG. 11A is a schematic diagram of an example of a margin data table;

FIG. 11B is a schematic diagram of an example of a content of margin data stored in the margin data table shown in FIG. 11A;

DETAILED DESCRIPTION OF THE PREFERRED EMBODIMENTS

Exemplary embodiments of the present invention are explained in detail below with reference to the accompanying drawings.

Figure 1A:
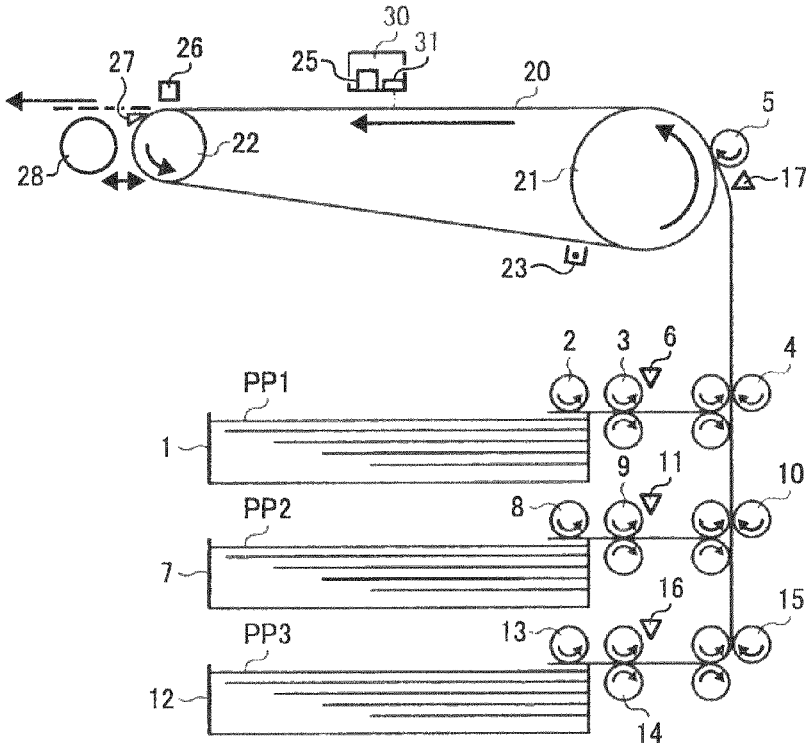
FIGS. 1A and 1B are schematic diagrams of a sheet conveying system and an image printing system of an image forming apparatus according to a first embodiment of the present invention.
Figure 1B:
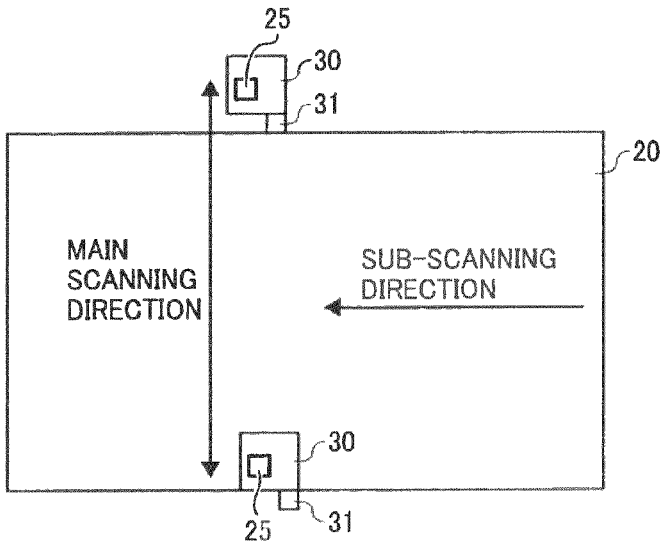

FIGS. 1A and 1B are schematic diagrams of a sheet conveying system and an image printing system of an image forming apparatus according to a first embodiment of the present invention. The image forming apparatus employs a serial head as a print head, and includes three sheet feed trays 1, 7, and 12.

The sheet feed tray 1 contains therein sheets PP1. A top sheet of the sheets PP1 is picked up by a pick-up roller 2, and fed to a pair of conveying rollers 3. The conveying rollers 3 convey the fed sheet PP1 to a conveying roller block 4. The conveying roller block 4 deflects the sheet PP1 upward to convey the sheet PP1 onto a sheet path up to a registration roller 5. A sheet sensor 6 is provided on the downstream of the conveying rollers 3, and detects whether the sheet PP1 passes through the conveying rollers 3.

The sheet feed tray 7 contains therein sheets PP2. A top sheet of the sheets PP2 is picked up by a pick-up roller 8, and fed to a pair of conveying rollers 9. The conveying rollers 9 convey the fed sheet PP2 to a conveying roller block 10. The conveying roller block 10 deflects the sheet PP2 upward to convey the sheet PP2 onto the sheet path up to the registration roller 5. Specifically, the sheet PP2 is conveyed to the conveying roller block 4 by the conveying roller block 10, and conveyed onto the sheet path up to the registration roller 5 by the conveying roller block 4. A sheet sensor 11 is provided on the downstream of the conveying rollers 9, and detects whether the sheet PP2 passes through the conveying rollers 9.

The sheet feed tray 12 contains therein sheets PP3. A top sheet of the sheets PP3 is picked up by a pick-up roller 13, and fed to a pair of conveying rollers 14. The conveying rollers 14 convey the fed sheet PP3 to a conveying roller block 15. The conveying roller block 15 deflects the sheet PP3 upward to convey the sheet PP3 onto the sheet path up to the registration roller 5. Specifically, the sheet PP3 is conveyed to the conveying roller block 10 by the conveying roller block 15, and conveyed to the conveying roller block 4 by the conveying roller block 10, and then conveyed onto the sheet path up to the registration roller 5 by the conveying roller block 4. A sheet sensor 16 is provided on the downstream of the conveying rollers 14, and detects whether the sheet PP3 passes through the conveying rollers 14.

A sheet sensor 17 is provided just anterior to the registration roller 5, and detects any of the sheets PP1, PP2, and PP3 conveyed onto the sheet path toward the registration roller 5. The conveyed sheet is struck on a nip portion formed between the registration roller 5 and a conveying roller 21.

A conveying belt 20 for conveying a sheet is supported by the conveying roller 21 and a conveying roller 22, and driven to move endlessly in a sub-scanning direction. When a surface of the conveying belt 20 is charged by a charger 23, an electrostatic force is generated thereon. The sheet struck on the nip portion is stuck on the surface of the conveying belt 20 by the action of the electrostatic force.

Specifically, while the registration roller 5 is in the conveying operation, the sheet struck on the nip portion is stuck on the surface of the conveying belt 20 by the action of the electrostatic force, so that the sheet passes through the nip portion along with the conveying belt 20. Then, the sheet is conveyed to a printing position of a print head 25. On the other hand, while the registration roller 5 is not in the conveying operation, i.e., the registration roller 5 is not running, the sheet is held at the nip portion in a state where the sheet is struck on the nip portion. In other words, the sheet is not conveyed, i.e., is stopped at the nip portion in this case.

After an image is printed on the sheet, an electricity eliminating unit 26 eliminates static electricity from the sheet. Therefore, the sheet becomes in such a condition that the sheet can be separated from the surface of the conveying belt 20. After that, the sheet is separated from the surface of the conveying belt 20 by a separation claw 27 from the side of a leading end of the sheet, and conveyed to a discharging unit (not shown).

A surface of a cleaning unit 28 is coated with an ink-absorbing material, such as absorbent sponge. The cleaning unit 28 is normally located with keeping a distance from the conveying belt 20. The cleaning unit 28 comes in contact with the conveying belt 20 when needed, and cleans ink from the surface of the conveying belt 20.

The print head 25 is mounted on a carriage 30. The carriage 30 reciprocates in a main scanning direction of an image to be printed. As the print head 25, a serial head is employed. The carriage 30 further mounts thereon a reflection-type photosensor 31 that emits a probe light to the conveying belt 20 and detects a light reflected on the conveying belt 20.

Figure 2:
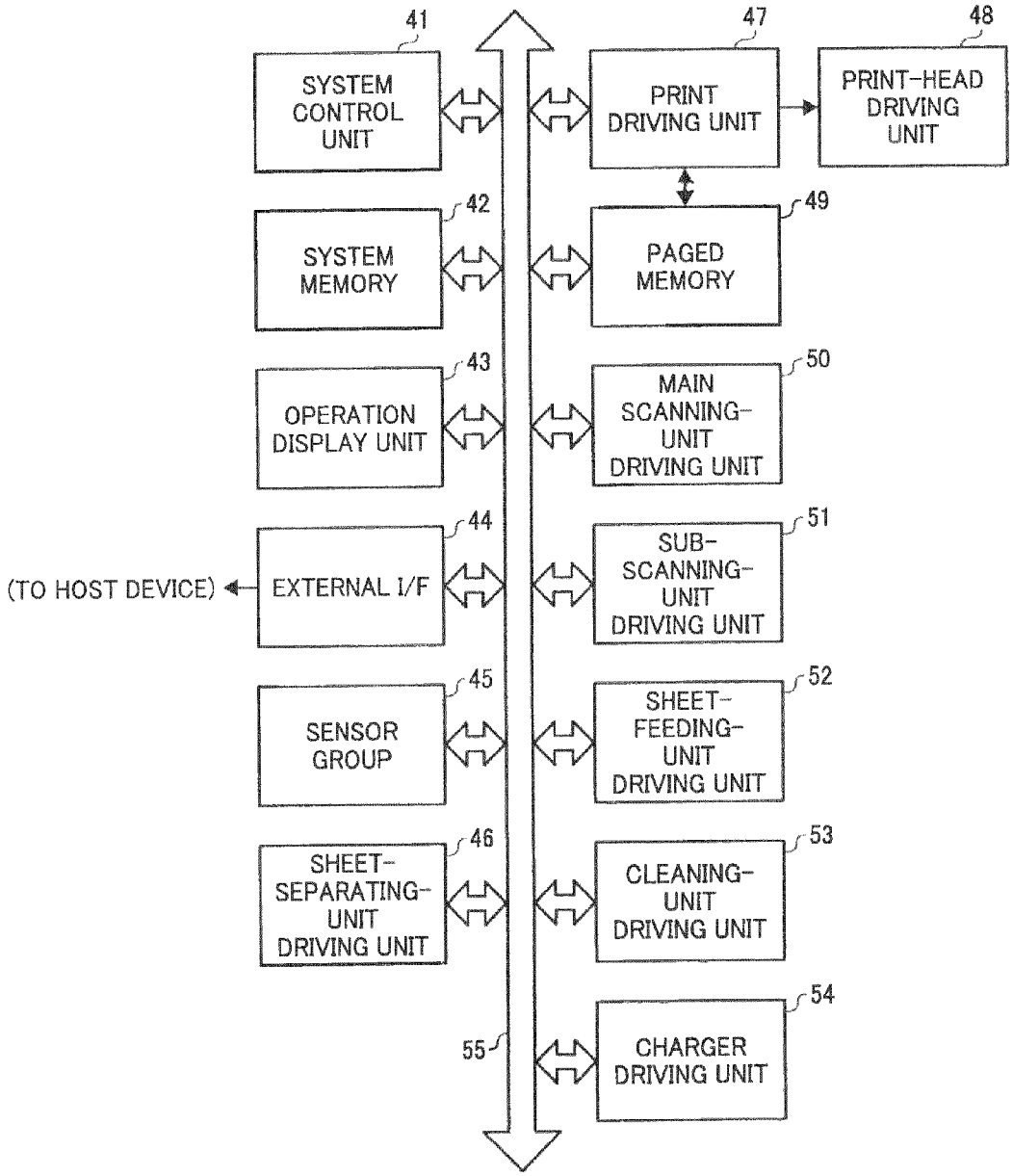
FIG. 2 is a block diagram of a control system of the image forming apparatus according to the first embodiment.

FIG. 2 is a block diagram of a control system of the image forming apparatus according to the first embodiment.

A system control unit 41 controls an operation of each of units included in the image forming apparatus, a print job, and the like. A system memory 42 is used to store therein a control processing program to be executed by the system control unit 41, data required for the execution of the processing program, information on the image forming apparatus, and the like. In addition, the system memory 42 serves as a working area of the system control unit 41. An operation display unit 43 includes an operation key and an indicator that are required for a user to operate the image forming apparatus. An external interface (I/F) 44 is used to connect the image forming apparatus to a host device such as a personal computer. In other words, the external I/F 44 is used for data transmission between the image forming apparatus to the host device.

A sensor group 45 includes sensors, such as a sensor for detecting whether an opening formed on an enclosure of the image forming apparatus is opened/closed and a sensor for detecting whether a door of the image forming apparatus is opened/closed. A sheet-separating-unit driving unit 46 drives each of the electricity eliminating unit 26 and the separation claw 27.

A print driving unit 47 appropriately drives a print-head driving unit 48. The print-head driving unit 48 drives the print head 25 to print an image. A paged memory 49 is used to store therein data on a printed image for one page. A main-scanning-unit driving unit 50 drives the carriage 30 to move, and drives the photosensor 31. A sub-scanning-unit driving unit 51 drives the conveying belt 20. A sheet-feeding-unit driving unit 52 drives a corresponding sheet feeding unit so that any of sheets PP1, PP2, and PP3 is fed from any of the sheet feed trays 1, 7, and 12.

A cleaning-unit driving unit 53 drives the cleaning unit 28 to clean the surface of the conveying belt 20. A charger driving unit 54 drives the charger 23.

The system control unit 41, the system memory 42, the operation display unit 43, the external I/F 44, the sensor group 45, the sheet-separating-unit driving unit 46, the print driving unit 47, the paged memory 49, the main-scanning-unit driving unit 50, the sub-scanning-unit driving unit 51, the sheet-feeding-unit driving unit 52, the cleaning-unit driving unit 53, and the charger driving unit 54 are connected to an internal bus 55. Data is exchanged among these units via the internal bus 55 mainly.

Figure 3:
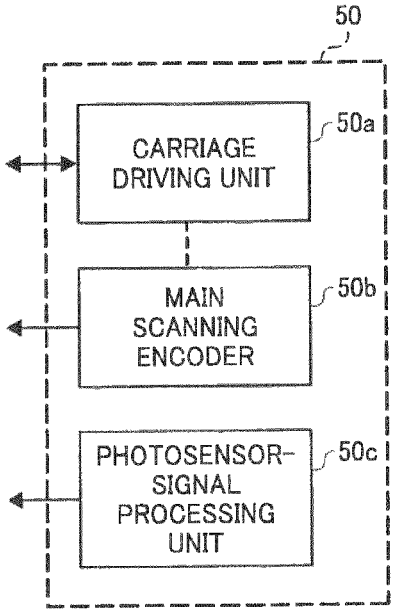
FIG. 3 is a block diagram of a configuration example of a main-scanning-unit driving unit shown in FIG. 2.

FIG. 3 is a block diagram of a configuration example of the main-scanning-unit driving unit 50.

The main-scanning-unit driving unit 50 includes a carriage driving unit 50*a*, a main-scanning encoder 50*b*, and a photosensor-signal processing unit 50*c*. The carriage driving unit 50*a* drives the carriage 30 to reciprocate in the main scanning direction. The main-scanning encoder 50*b* is used to detect a coordinate of a location of the carriage 30 in the main scanning direction. The photosensor-signal processing unit 50*c* processes a detection signal from the photosensor 31.

Figure 4:
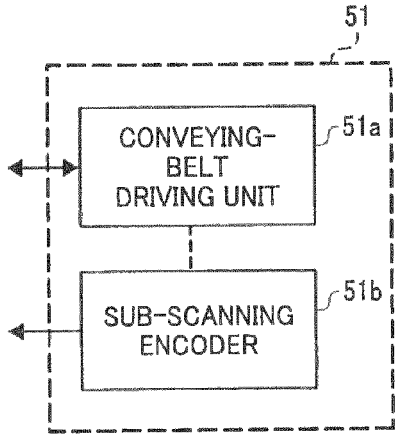
FIG. 4 is a block diagram of a configuration example of a sub-scanning-unit driving unit shown in FIG. 2.

FIG. 4 is a block diagram of a configuration example of the sub-scanning-unit driving unit 51.

The sub-scanning-unit driving unit 51 includes a conveying-belt driving unit 51*a* and a sub-scanning encoder 51*b*. The conveying-belt driving unit 51*a* drives the conveying belt 20 to move. The sub-scanning encoder 51*b* is used to detect a travel distance of the conveying belt 20 in a conveying direction.

Figure 5:
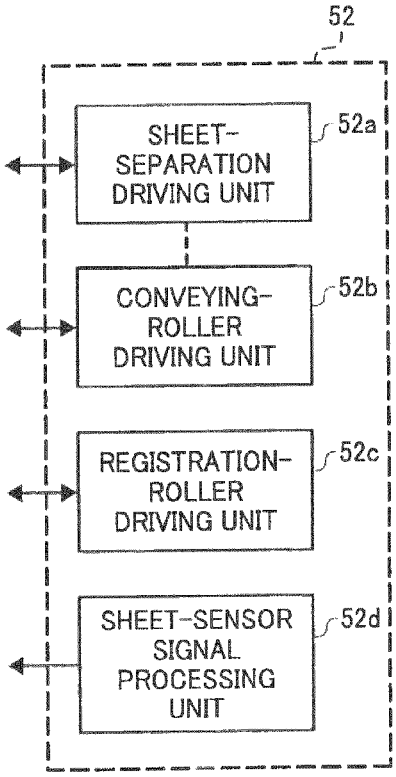
FIG. 5 is a block diagram of a configuration example of a sheet-feeding-unit driving unit shown in FIG. 2.

FIG. 5 is a block diagram of a configuration example of the sheet-feeding-unit driving unit 52.

The sheet-feeding-unit driving unit 52 includes a sheet-separation driving unit 52*a*, a conveying-roller driving unit 52*b*, a registration-roller driving unit 52*c*, and a sheet-sensor signal processing unit 52*d*. The sheet-separation driving unit 52*a* drives each of the pick-up rollers 2, 8, and 13 to pick up any of corresponding sheets PP1, PP2, and PP3 so that the sheets can be separately conveyed one by one. The conveying-roller driving unit 52*b* drives each of the pairs of the conveying rollers 3, 9, and 14 and the conveying roller blocks 4, 10, and 15. The registration-roller driving unit 52*c* drives the registration roller 5. The sheet-sensor signal processing unit 52*d* processes a detection signal from each of the sheet sensors 6, 11, 16, and 17.

Figure 6:
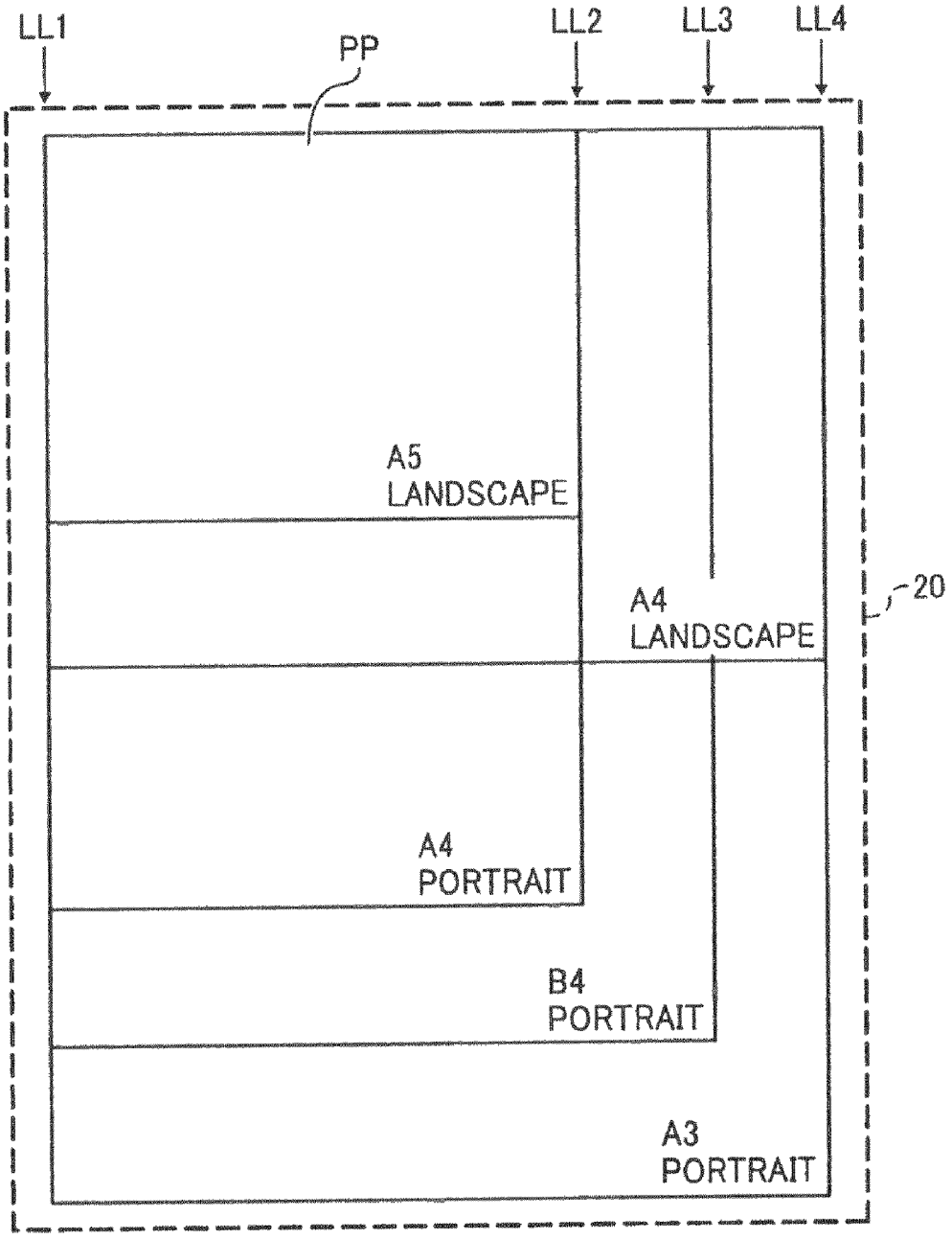
FIG. 6 is a schematic diagram of an example of a sheet conveyance in a left alignment.
Figure 7:
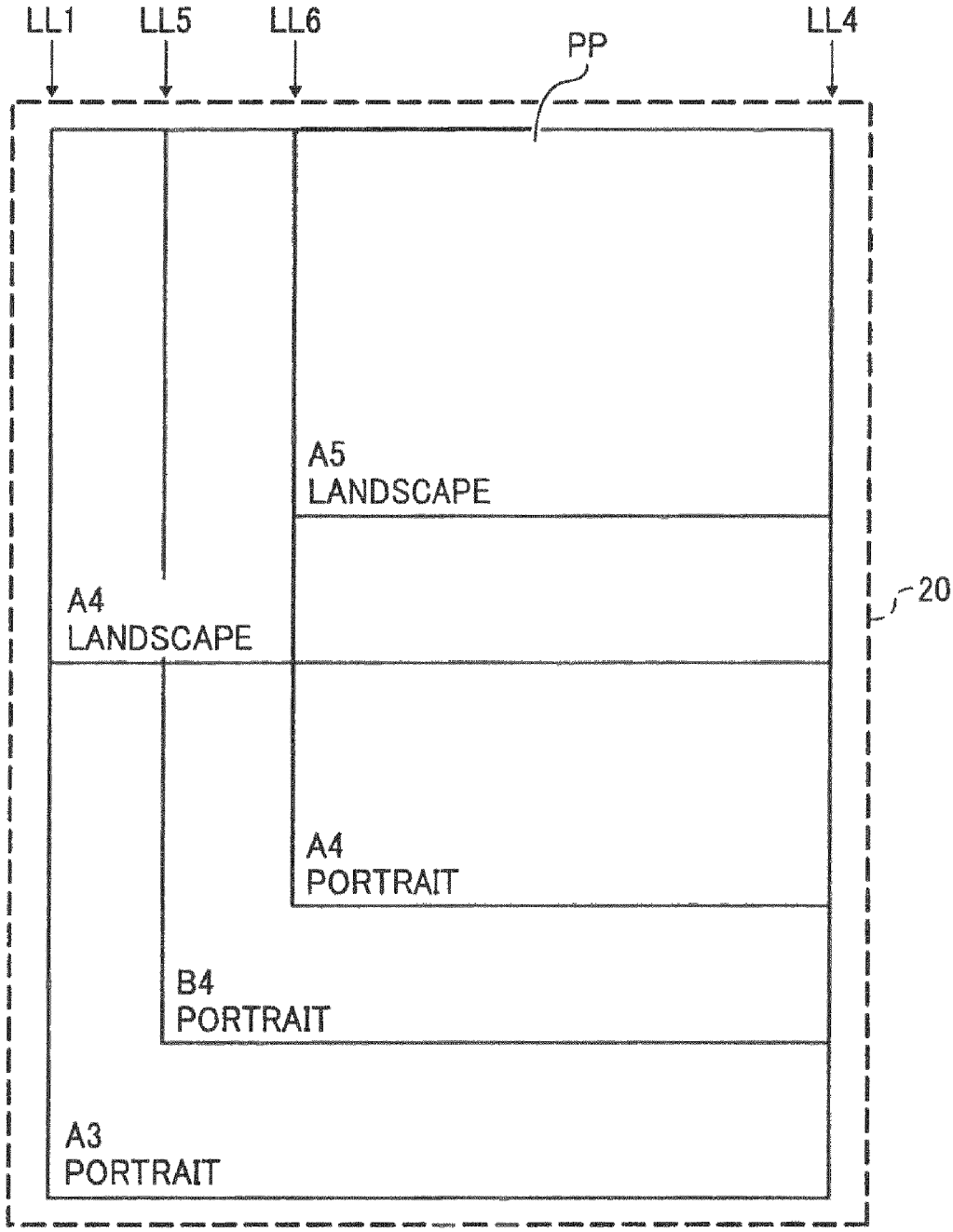
FIG. 7 is a schematic diagram of an example of a sheet conveyance in a right alignment.
Figure 8:
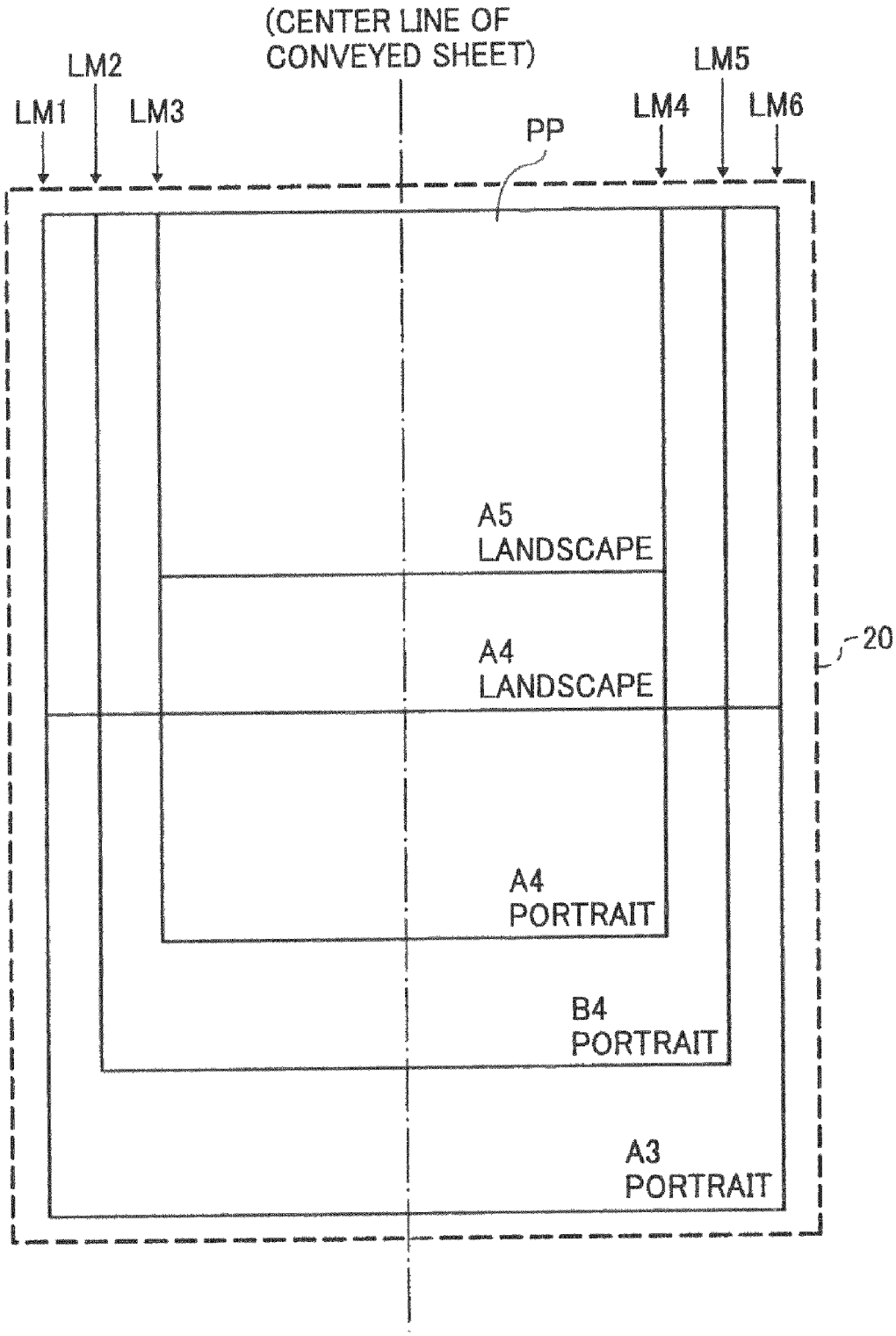
FIG. 8 is a schematic diagram of an example of a sheet conveyance in a center alignment.

FIG. 6 is a schematic diagram of an example of a sheet conveyance in a left alignment. FIG. 7 is a schematic diagram of an example of a sheet conveyance in a right alignment. FIG. 8 is a schematic diagram of an example of a sheet conveyance in a center alignment. The image forming apparatus can select an alignment method of the sheet PP (i.e., any of the sheets PP1, PP2, and PP3) conveyed on the conveying belt 20 from any of the left alignment, the right alignment, and the center alignment shown in FIGS. 6 to 8.

As for a size (and an orientation) of the sheet PP, an A3 portrait, a B4 portrait, an A4 portrait, an A4 landscape, and an A5 landscape are applicable to the image forming apparatus in this case. Incidentally, as a matter of practical convenience, the conveying belt 20 is depicted in larger size than the A3 portrait as the maximum size in FIGS. 6 to 8. However, it does not mean that a distance between the conveying rollers 21 and 22 is larger than a longer length of the A3 sheet. Namely, the conveying belt 20 is driven to move endlessly, so that the conveying belt 20 can be considered to have an infinite dimension in a moving direction. Thus, FIGS. 6 to 8 show that a width of the conveying belt 20 (in a direction perpendicular to the conveying direction) is set to be slightly larger than a shorter length of the A3 sheet.

In a case of the left alignment (see FIG. 6), a left end portion of each of the sheets in all the sizes is aligned at a coordinate LL1. Furthermore, a right end portion of each of the A5 landscape and the A4 portrait is aligned at a coordinate LL2. Likewise, a right end portion of the B4 portrait is aligned at a coordinate LL3, and a right end portion of each of the A4 landscape and the A3 portrait is aligned at a coordinate LL4.

In a case of the right alignment (see FIG. 7), a right end portion of each of the sheets in all the sizes is aligned at the coordinate of LL4. Furthermore, a left end portion of each of the A5 landscape and the A4 portrait is aligned at a coordinate LL6. Likewise, a left end portion of the B4 portrait is aligned at a coordinate LL5, and a left end portion of each of the A4 landscape and the A3 portrait is aligned at the coordinate of LL1.

In a case of the center alignment (see FIG. 8), a left end portion of each of the A5 landscape and the A4 portrait is aligned at a coordinate LM3, and a right end portion of each of which is aligned at a coordinate LM4. A left end portion of the B4 portrait is aligned at a coordinate LM2, and a right end portion of which is aligned at a coordinate LM5. A left end portion of each of the A4 landscape and the A3 portrait is aligned at a coordinate LM1, and a right end portion of each of which is aligned at a coordinate LM6.

As a reference position (an origin) of each of the coordinates, a reference position in the main scanning direction (for example, a home position of the carriage 30) can be employed.

In this manner, a length of a print area of the sheet PP in the main scanning direction depends on an alignment method, a size, and an orientation of the sheet PP. To define the print area, for example, a sheet-size data table can be created, and stored in the system memory 42 in advance. FIG. 9A is a schematic diagram of an example of the sheet-size data table. FIG. 9B is a schematic diagram of an example of a content of sheet size data (i.e., data on a width and a length of a sheet by each size) stored in the sheet-size data table shown in FIG. 9A. Incidentally, custom sheet size data is stored in the sheet-size data table only when a user enters a custom sheet size.

Figure 10:
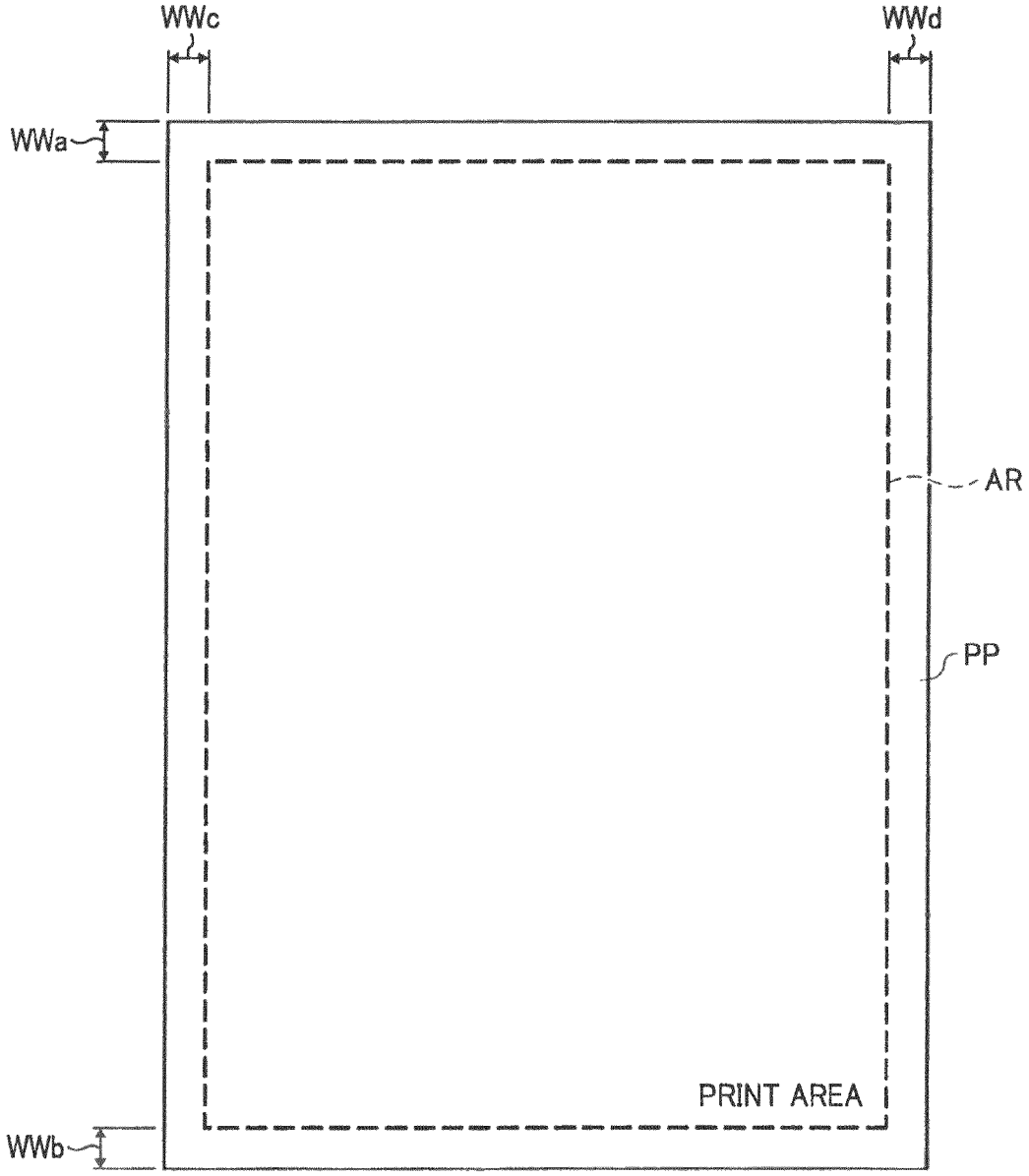
FIG. 10 is a schematic diagram for explaining an example of a relation among sheet size, print area, and margin.

FIG. 10 is a schematic diagram for explaining an example of a relation among sheet size, print area, and margin. When an image is printed on a sheet PP, a print area AR is determined by setting margins in the left, right, top, and bottom of the sheet PP. In a case shown in FIG. 10, a top margin WWa, a bottom margin WWb, a left margin WWc, and a right margin WWd are spaced out.

Standard values of the top margin WWa, the bottom margin WWb, the left margin WWc, and the right margin WWd are stored as standard margin data in a margin data table. Furthermore, pattern-printed-sheet margin data about values of top, bottom, left, and right margins for a pattern-printed sheet is also stored in the margin data table. The margin data table is stored in the system memory 42. FIG. 11A is a schematic diagram of an example of the margin data table. FIG. 11B is a schematic diagram of an example of a content of margin data stored in the margin data table shown in FIG. 11A. Incidentally, as will be explained in detail later, the pattern-printed-sheet margin data is preferably set by each of the trays. As the pattern-printed-sheet margin data, an offset value with respect to the standard value can be stored.

Subsequently, a printing method performed by the image forming apparatus according to the first embodiment is explained in detail below. In the first embodiment, the printing method differs depending on a type of sheet used as each of the sheets PP1, PP2, and PP3. In this case, there are two types of sheets, i.e., a white plain sheet without any printed pattern (hereinafter, "a normal sheet") and a pattern-printed sheet such as company stationery with a company logo or a designed pattern. Incidentally, a plain sheet in color other than white (for example, a black plain sheet) is regarded as the pattern-printed sheet.

First, a case where the image forming apparatus prints an image on a normal sheet is explained below. In this case, with the photosensor 31, whether a leading end portion of the normal sheet comes to a printing position is detected, and also positions of right and left end portions of the normal sheet are detected.

Figure 12:
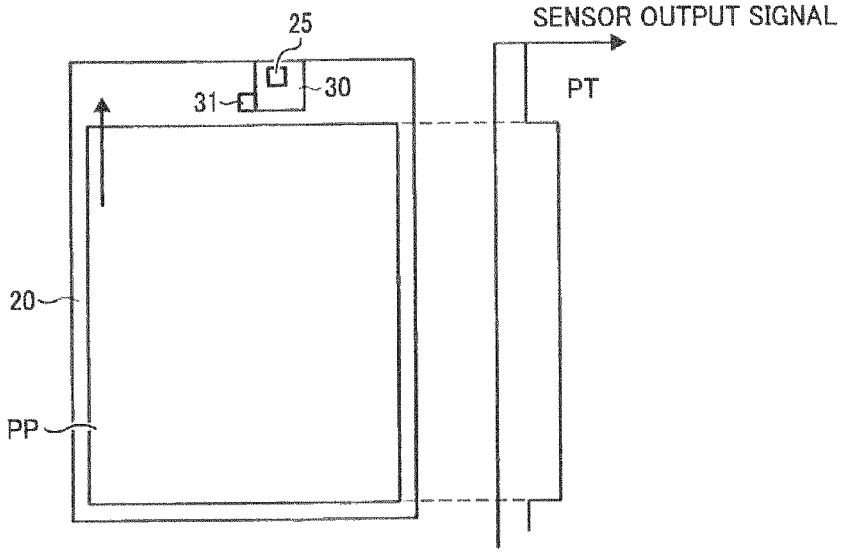
FIG. 12 is a schematic diagram for explaining how to detect leading and trailing end portions of a sheet based on an output signal from a photosensor.
Figure 13:
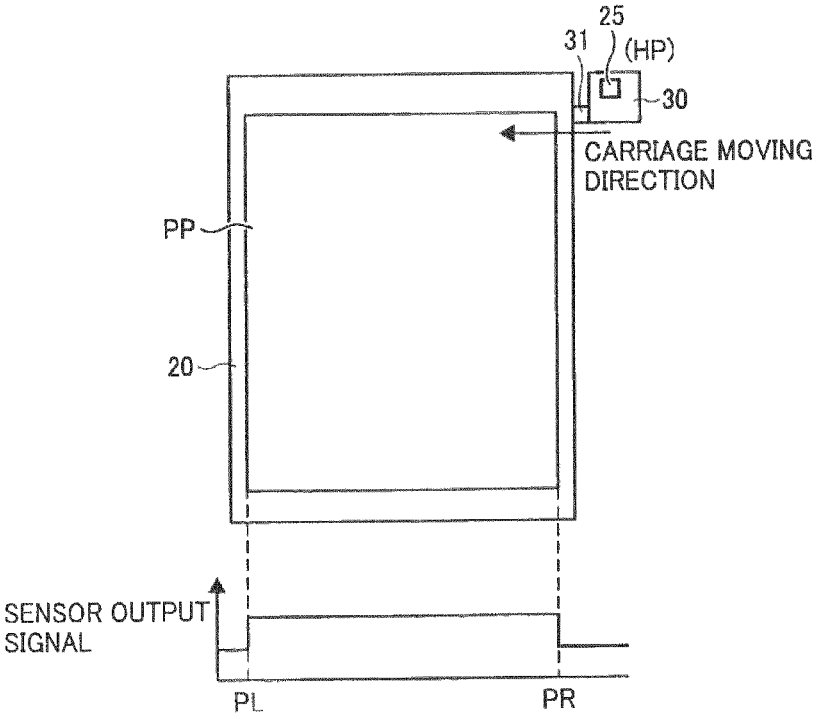
FIG. 13 is a schematic diagram for explaining how to detect right and left end portions of a sheet based on an output signal from the photosensor.

FIG. 12 is a schematic diagram for explaining how to detect leading and trailing end portions of a sheet PP based on an output signal from the photosensor 31. FIG. 13 is a schematic diagram for explaining how to detect right and left end portions of the sheet PP based on an output signal from the photosensor 31. As shown in FIG. 12, the detection of the leading end portion of the sheet PP is performed in such a state that the carriage 30 is moved so that the photosensor 31 is positioned in the substantially center of the conveying belt 20.

A light reflectance of the conveying belt 20 is set to be lower than that of the sheet PP. Therefore, while the photosensor 31 senses the conveying belt 20, a level of an output signal from the photosensor 31 is low. When the photosensor 31 senses the sheet PP, a level of an output signal from the photosensor 31 becomes high.

Thus, when a level of an output signal from the photosensor 31 is changed from low to high, it can be determined that a leading end portion PT of the sheet PP comes just anterior to the printing position.

Then, the detection of positions of right and left end portions of the sheet PP is performed upon detection of the leading end portion PT. As shown in FIG. 13, the carriage 30 is moved so that the photosensor 31 is positioned in such a position that the photosensor 31 can sense the conveying belt 20 in a width direction entirely in accordance with the movement of the carriage 30 from the home position in the main scanning direction.

In this case, while the photosensor 31 senses the conveying belt 20, a level of an output signal from the photosensor 31 is low. When the photosensor 31 senses the sheet PP, a level of an output signal from the photosensor 31 becomes high. Therefore, when a level of an output signal from the photosensor 31 is changed from low to high, it can be determined that a right end portion PR of the sheet PP is detected. Thus, by detecting a position of the carriage 30 in the main scanning direction at this time, coordinates of the right end portion PR of the sheet PP can be obtained.

After that, when a level of an output signal from the photosensor 31 is changed from high to low, it can be determined that a left end portion PL of the sheet PP is detected. Thus, by detecting a position of the carriage 30 in the main scanning direction at this time, coordinates of the left end portion PL of the sheet PP can be obtained.

In this manner, before an image is printed on the sheet PP, the leading end portion PT can be detected, and the coordinates of the right and left end portion PR and PL can be obtained. Therefore, the image forming apparatus can grasp a position of the sheet PP accurately. Thus, the image forming apparatus can print the image on the sheet PP properly.

Subsequently, a case where the image forming apparatus prints an image on a pattern-printed sheet is explained below. If the image forming apparatus prints an image on a pattern-printed sheet in the same manner as in the case of the normal sheet, the photosensor 31 may sense right and left end portions of the pattern-printed sheet incorrectly, and thus the image forming apparatus may fail to print the image on the pattern-printed sheet within a specified print area.

Figure 14A:
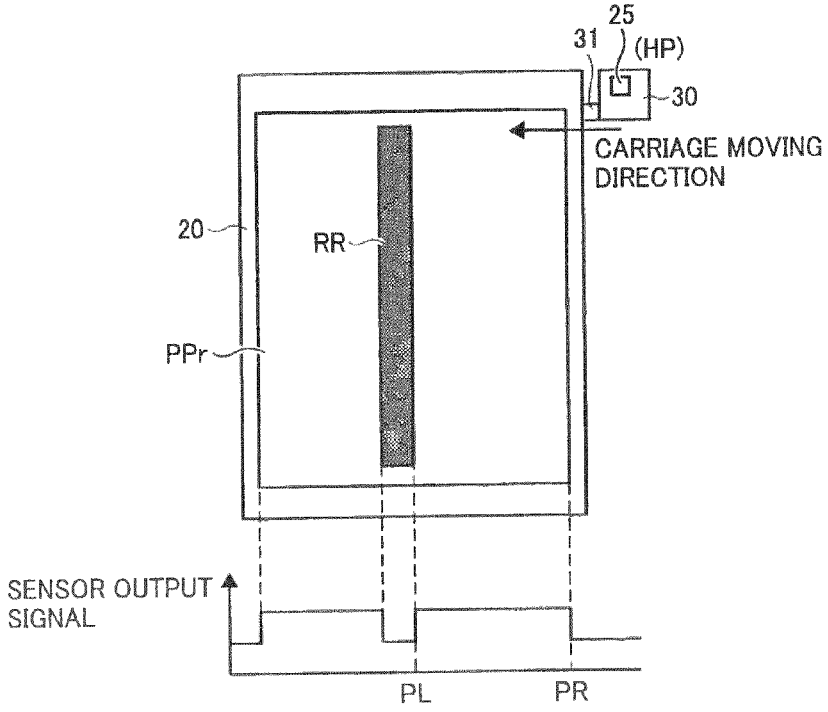
FIGS. 14A and 14B are schematic diagrams for explaining a cause of a false detection of right and left end portions of a sheet based on an output signal from the photosensor.
Figure 14B:
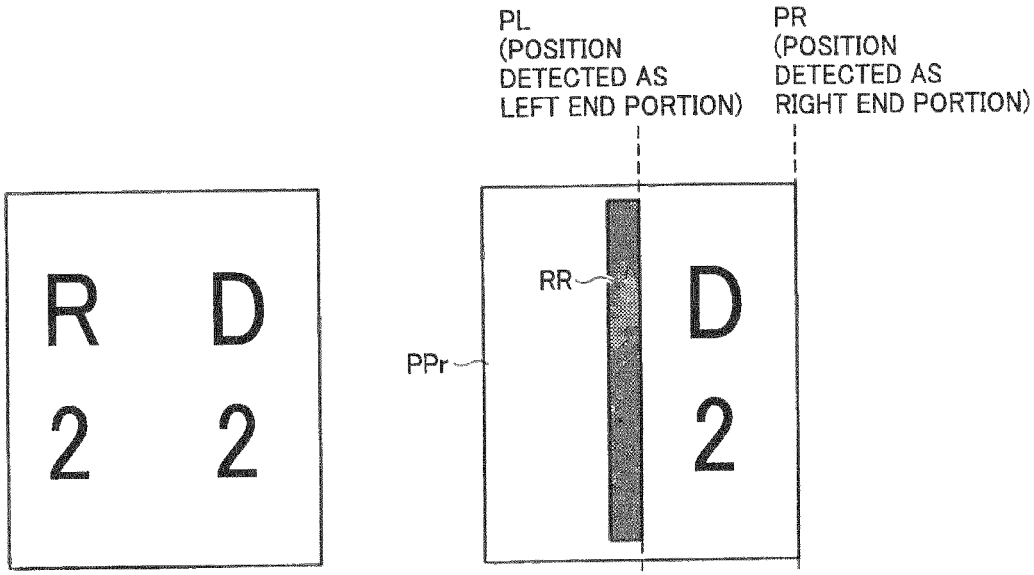

FIGS. 14A and 14B are schematic diagrams for explaining a cause of a false detection of right and left end portions of a pattern-printed sheet based on an output signal from the photosensor 31. It is assumed that, as shown in FIG. 14A, a pattern-printed sheet PPr has a relatively large printed pattern RR extending in the sub-scanning direction on the substantially center of which. When a level of an output signal from the photosensor 31 while sensing the printed pattern RR is lower than that is while sensing a background of the pattern-printed sheet PPr, an end portion of the printed pattern RR sensed by the photosensor 31 may be incorrectly determined as a left end portion PL of the pattern-printed sheet PPr.

In this case, for example, although an image shown on the left in FIG. 14B is to be printed, an image shown on the right in FIG. 14B is printed on the pattern-printed sheet PPr. Namely, a user-intended image cannot be printed on the pattern-printed sheet PPr because the substantially center of the pattern-printed sheet PPr is regarded as the left end portion PL incorrectly, i.e., a print area is narrowed down.

To avoid such a problem, when an image is to be printed on a pattern-printed sheet, a user needs to preliminarily select a pattern-printed sheet as a print sheet and specify a size of the selected pattern-printed sheet.

Figure 15A:
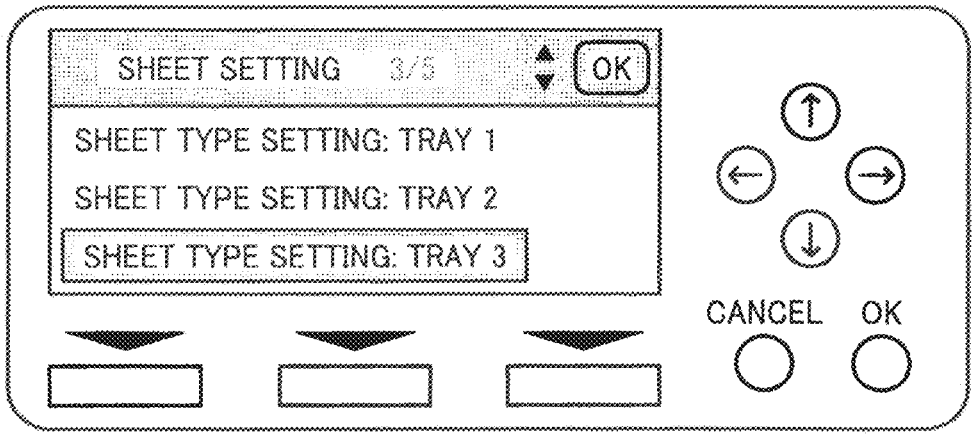
FIGS. 15A and 15B are schematic diagrams of an example of a sheet-type setting screen displayed on an operation display unit shown in FIG. 2.
Figure 15B:
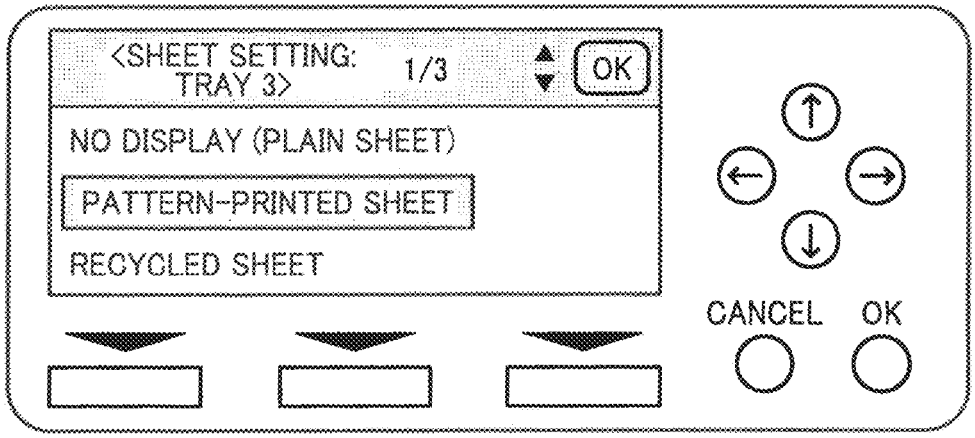

FIGS. 15A and 15B are schematic diagrams of an example of a sheet-type setting screen displayed on the operation display unit 43. A user specifies a tray 3 through a screen shown in FIG. 15A, and presses an "OK" button, so that a screen shown in FIG. 15B appears. The user can confirm that the tray 3 containing pattern-printed sheets is selected. As a result, information on a type of sheet (in this case, the pattern-printed sheet) can be obtained.

Figure 16A:
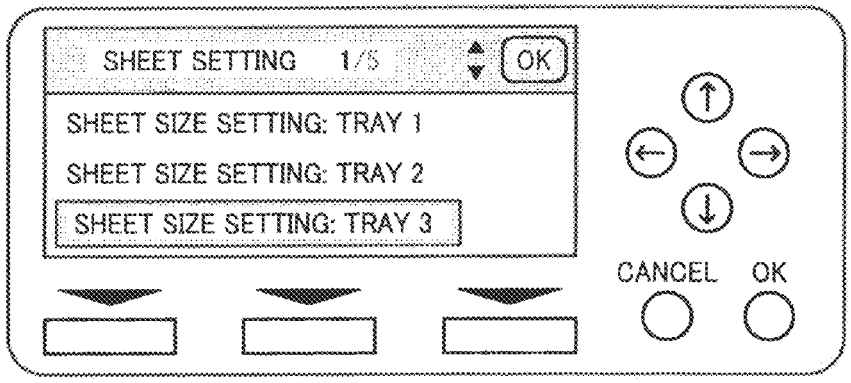
FIGS. 16A to 16C are schematic diagrams of an example of a sheet-size setting screen displayed on the operation display unit.
Figure 16B:
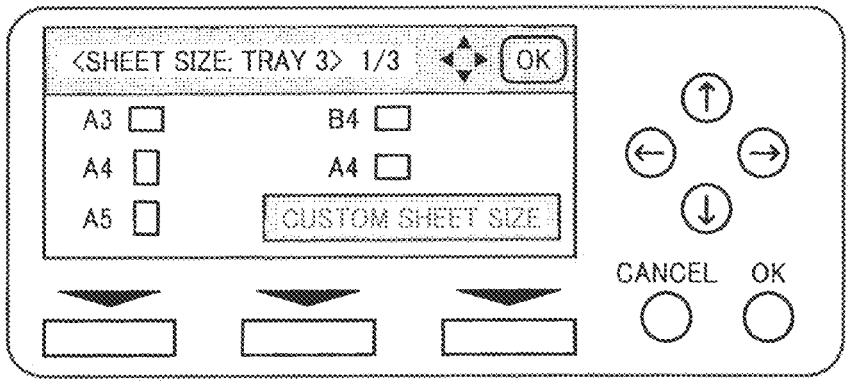
Figure 16C:
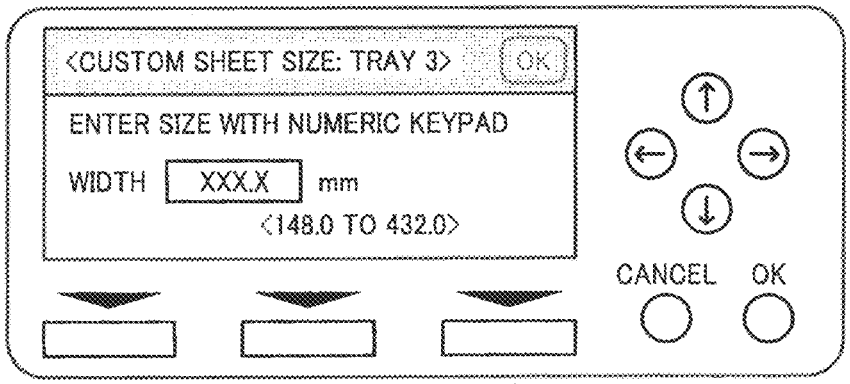

FIGS. 16A to 16C are schematic diagrams of an example of a sheet-size setting screen displayed on the operation display unit 43. A user specifies a tray 3 through a screen shown in FIG. 16A, and presses the "OK" button, so that a screen shown in FIG. 16B appears. The user specifies a size of sheet (pattern-printed sheet) contained in the tray 3 as a custom sheet size through the screen shown in FIG. 16B, and presses the "OK" button, so that a screen shown in FIG. 16C appears. The user enters a specific size of the pattern-printed sheet with a numeric keypad, so that the size of the pattern-printed sheet is set. Incidentally, if the user specifies a size of sheet as a standard sheet size, such as "A3", through the screen shown in FIG. 16B and presses the "OK" button, the screen shown in FIG. 16C does not appear, i.e., the user need not enter a specific size of the pattern-printed sheet.

In the above example, a size of pattern-printed sheet is specified by an entry on the sheet-size setting screen displayed on the operation display unit 43 with the numeric keypad. A method of setting a size of pattern-printed sheet differs depending on a model of an image forming apparatus. For example, in a different model of an image forming apparatus, a dial (not shown) is provided on each of sheet feed trays, so that a user specifies a size of pattern-printed sheet with the dial. Furthermore, as another example, as one of the sensor group 45, a sheet-size detecting sensor (not shown) can be provided on each of the sheet feed trays, so that when a user selects a tray containing pattern-printed sheets, the sheet-size detecting sensor provided on the selected tray automatically detects a size of the pattern-printed sheet and sets the size of the pattern-printed sheet. As a result, information on the size of the selected pattern-printed sheet can be obtained.

Moreover, when a user selects a pattern-printed sheet as a print sheet, the system control unit 41 controls not to perform the detection of right and left end portions of the pattern-printed sheet based on an output signal from the photosensor 31. The system control unit 41 controls to determine a print area in the width direction in such a manner that sheet size data corresponding to the selected sheet size is acquired from the sheet-size data table stored in the system memory 42, and coordinates of the right and left end portions of the pattern-printed sheet, i.e., a width of the pattern-printed sheet is calculated based on the acquired sheet size data. After that, an image is printed on the pattern-printed sheet within the determined print area.

For example, when an image is to be printed on an A4 portrait sheet conveyed in the center alignment, a length of the A4 sheet is 210 millimeters (mm), so that a coordinate LM3 of a left end portion of the A4 portrait sheet is −105 mm, and a coordinate LM4 of a right end portion of the A4 portrait sheet is +105 mm (see FIG. 8). The image is printed on the A4 portrait sheet within an area between the coordinates LM3 and LM4.

In this manner, in the present embodiment, it is possible to prevent a false detection of right and left end portions of a sheet. Therefore, it is possible to print an image on the sheet properly.

Figure 17:
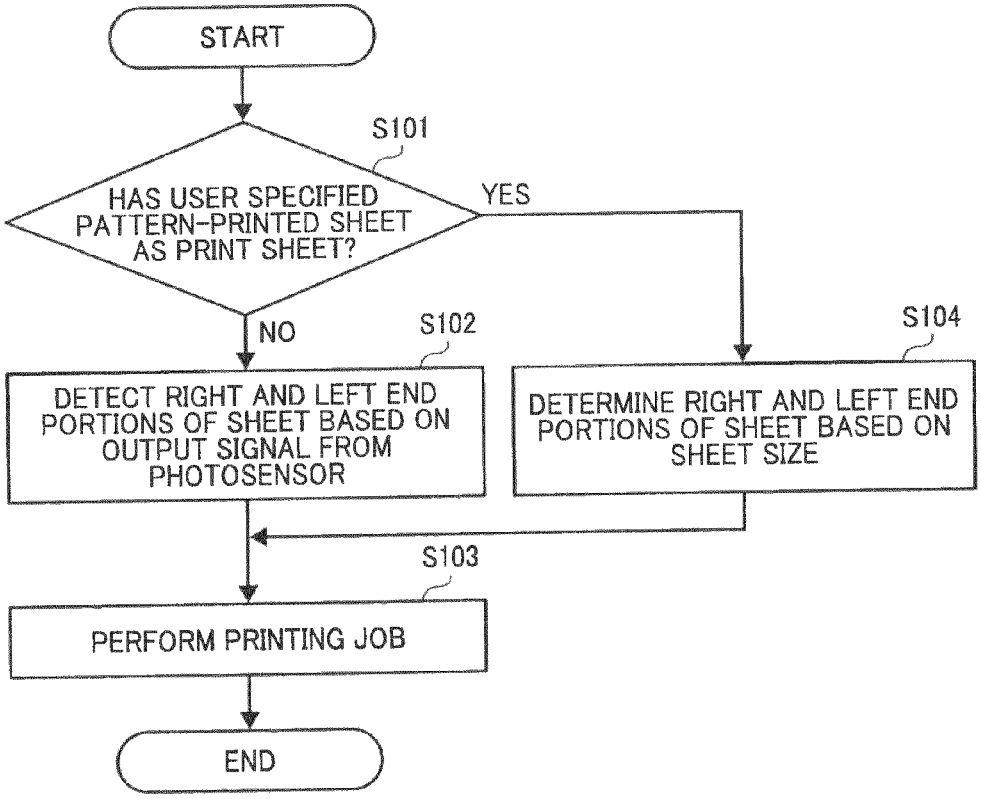
FIG. 17 is a flowchart of an example of a process performed by the image forming apparatus according to the first embodiment for determining a print area based on right and left end portions of a sheet.

FIG. 17 is a flowchart of an example of a process performed by the image forming apparatus for determining a print area based on right and left end portions of a sheet.

Whether a user has specified a pattern-printed sheet as a print sheet is checked (Step S101). When the user has not specified a pattern-printed sheet as a print sheet, i.e., a print sheet is not a pattern-printed sheet (NO at Step S101), right and left end portions of the print sheet are detected based on an output signal from the photosensor 31 (Step S102). The image forming apparatus performs a print job based on coordinates of the detected right and left end portions (Step S103).

When the user has specified a pattern-printed sheet as a print sheet (YES at Step S101), positions of right and left end portions of the pattern-printed sheet are determined by calculating coordinates of the right and left end portions based on sheet size data acquired from the sheet-size data table stored in the system memory 42 (Step S104). The process control goes to Step S103, and the forming apparatus performs a print job based on the coordinates obtained at Step S104 (Step S103).

Incidentally, in the present embodiment, the system control unit 41 controls to print an image on a sheet within a print area in the width direction that is determined in such a manner that sheet size data corresponding to a size of the selected sheet is acquired from the sheet-size data table, and coordinates of right and left end portions of the sheet, i.e., a width of the sheet is calculated based on the acquired sheet size data. Alternatively, coordinates of right and left end portions of a sheet by each size, i.e., a width of the sheet by each size can be calculated, and stored as sheet-coordinate data in a sheet-coordinate data table in advance. In this case, the system control unit 41 controls to perform a print job in such a manner that sheet-coordinate data corresponding to a size of the selected sheet is acquired from the sheet-coordinate data table, and an image is printed on the sheet within a print area obtained based on the sheet-coordinate data.

In this manner, the image forming apparatus according to the present embodiment can prevent an occurrence of such conventional problems that a portion of an image is not printed on a sheet or a specified area of the sheet because of failing to print the image on the sheet within a print area accurately.

Furthermore, the image forming apparatus according to the present embodiment can prevent such a print error that a portion of an image is not printed on a sheet. Therefore, the portion of the image is not printed on the conveying belt, i.e., the conveying belt can be prevented from being stained with ink. Thus, it is possible to prevent an uplift behavior of the sheet from the conveying belt because the electrostatic force acting on the sheet is not reduced. Consequently, a surface of the sheet is not rubbed against a print head, so that it is possible to prevent an occurrence of such problems that a printed image is blurred or the print head is damaged.

Figure 18A:
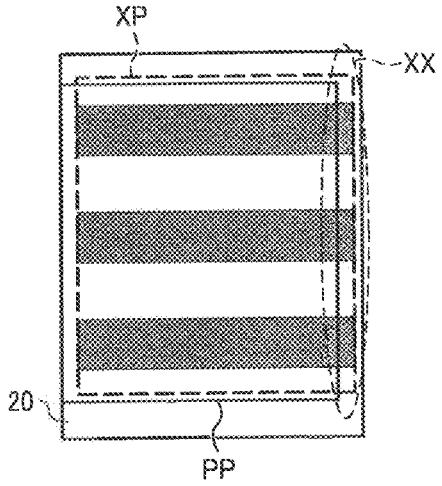
FIG. 18A is a schematic diagram showing a state where a sheet is out of alignment on a conveying belt.

In a case where an image is printed on a pattern-printed sheet without using the above method, i.e., without detecting right and left end portions of the pattern-printed sheet based on an output signal from the photosensor 31, when the pattern-printed sheet is conveyed askew on the conveying belt 20, the pattern-printed sheet is out of alignment on the conveying belt 20, i.e., is not aligned at a proper position on the conveying belt 20. FIG. 18A is a schematic diagram showing a state where a sheet PP is out of alignment on the conveying belt 20.

In this case, if an image is printed on a print area XP obtained based on coordinates of right and left end portions of the sheet PP determined by the system control unit 41, an actual position of the sheet PP does not correspond to the coordinates of the right and left end portions. Therefore, the print area XP is partially got out of the sheet PP, so that an image corresponding to an area XX is printed on the conveying belt 20.

Figure 18B:
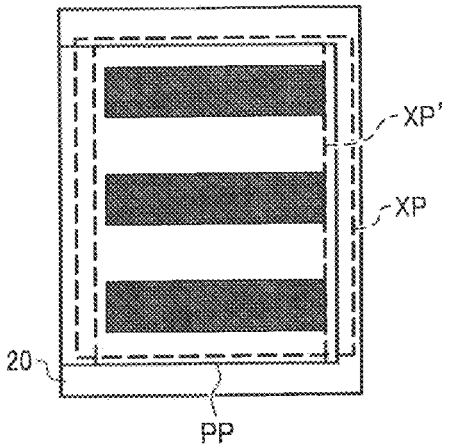
FIG. 18B is a schematic diagram for explaining a print area of a sheet with an extended margin.

To avoid such a situation, for example, the print area XP is changed to a print area XP', and right and left margins of the sheet PP are extended. FIG. 18B is a schematic diagram for explaining the print area XP' of the sheet PP with the extended right and left margins.

Figure 18C:
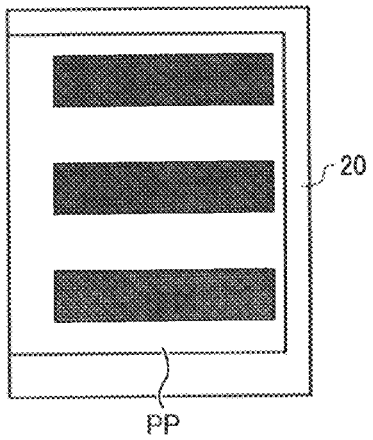
FIG. 18C is a schematic diagram showing a printed image that is printed on the sheet within the print area shown in FIG. 18B.
Figure 19A:
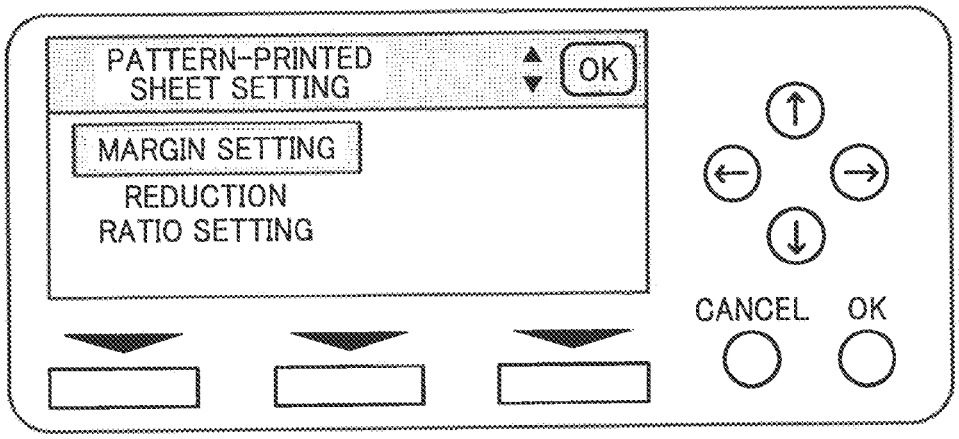
FIGS. 19A to 19D are schematic diagrams of an example of a pattern-printed-sheet margin setting screen displayed on the operation display unit.
Figure 19B:
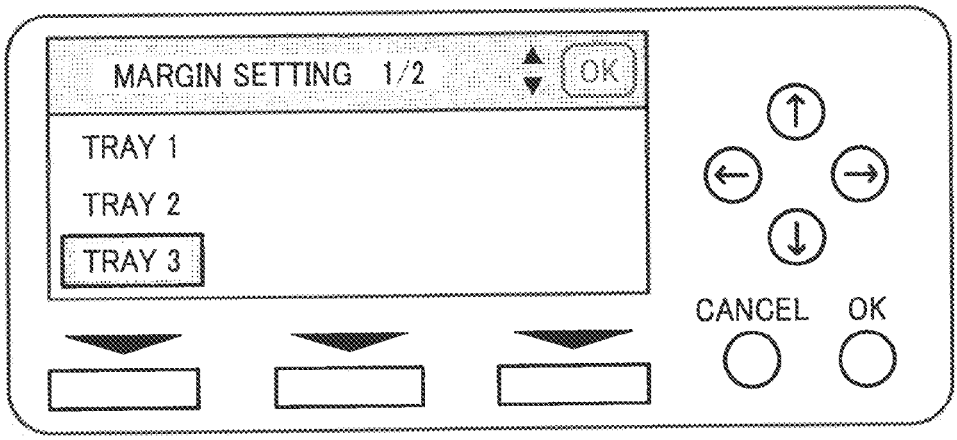
Figure 19C:
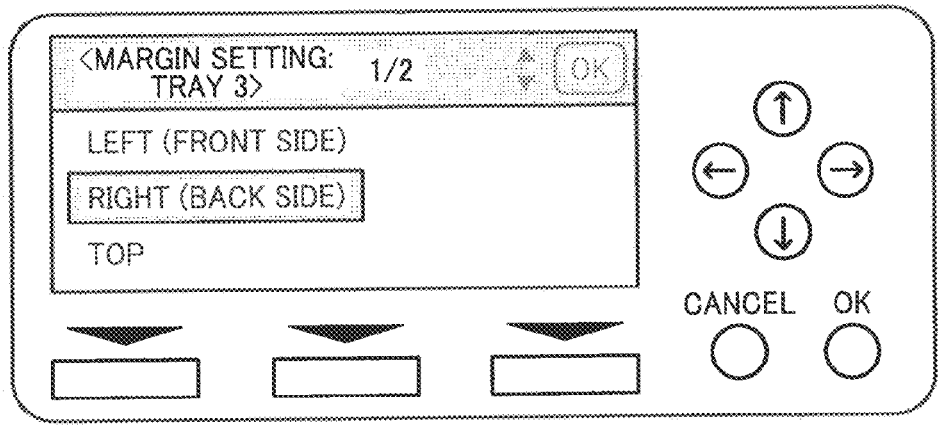
Figure 19D:
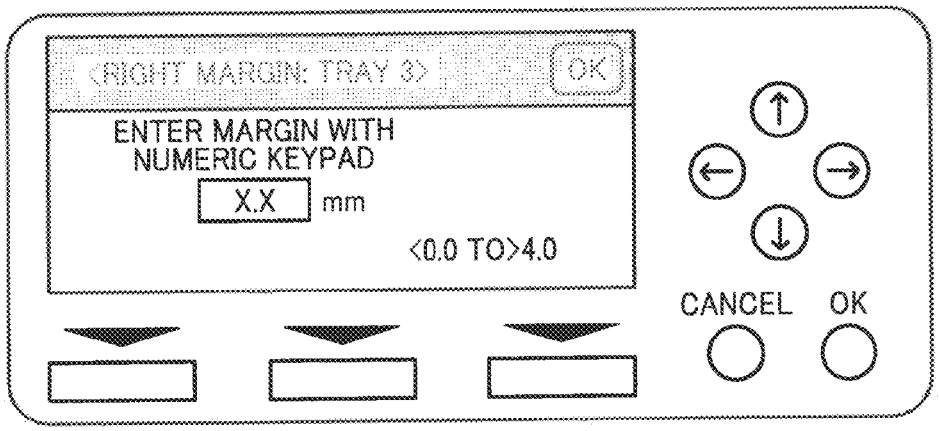

In such a way, the image can be printed on the sheet PP within the print area XP'. Thus, it is possible to prevent the conveying belt 20 from being stained with ink. FIG. 18C is a schematic diagram showing a printed image that is printed on the sheet PP within the print area XP'.

To print an image on a pattern-printed sheet with extended margins as described above, a user needs to set values of margins of the pattern-printed sheet through a pattern-printed-sheet setting screen in advance.

FIGS. 19A to 19D are schematic diagrams of an example of a pattern-printed-sheet margin setting screen displayed on the operation display unit 43. A user specifies a margin setting through a screen shown in FIG. 19A, and presses the "OK" button, so that a screen shown in FIG. 19B appears. The user selects a tray 3 (in which pattern-printed sheets are contained) through the screen shown in FIG. 19B, and presses the "OK" button, so that a screen shown in FIG. 19C appears. The user specifies a right (back side) margin as a margin to be set through the screen shown in FIG. 19C, and presses the "OK" button, so that a screen shown in FIG. 19D appears. The user enters a specific value of the margin with the numeric keypad, so that the margin is set. Incidentally, as a travel distance of the conveying belt 20 increases, a degree of a misalignment of a sheet PP in the width direction on the conveying belt 20 due to a skew of the sheet PP is getting increased. Therefore, the margin is preferably set by each of the sheet feed trays 1, 7, and 12.

The margin set by a user is stored as pattern-printed-sheet margin data (by each of the trays) in a margin data table stored in the system memory 42.

Figure 20:
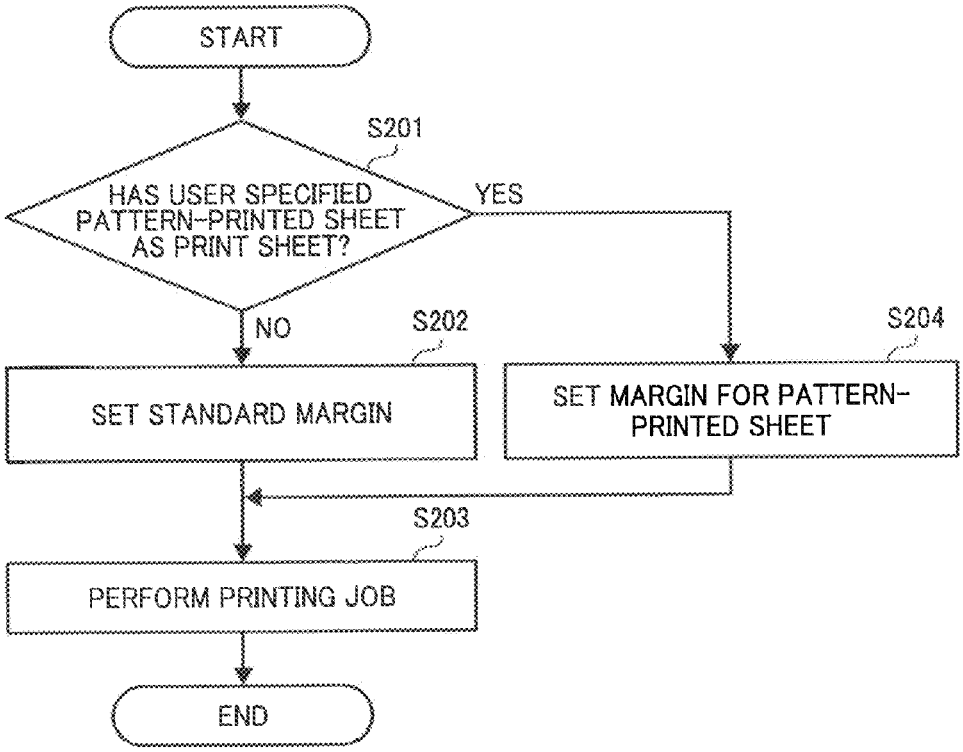
FIG. 20 is a flowchart of an example of a process performed by the image forming apparatus according to the first embodiment for setting a margin depending on a type of sheet.

FIG. 20 is a flowchart of an example of a process performed by the image forming apparatus for setting a margin depending on a type of sheet.

Whether a user has specified a pattern-printed sheet as a print sheet is checked (Step S201). When the user has not specified a pattern-printed sheet as a print sheet, i.e., a print sheet is not a pattern-printed sheet (NO at Step S201), standard margin data is acquired from the margin data table stored in the system memory 42 (Step S202). The image forming apparatus performs a print job based on the acquired standard margin data (Step S203).

When the user has specified a pattern-printed sheet as a print sheet (YES at Step S201), pattern-printed-sheet margin data is acquired from the margin data table stored in the system memory 42 (Step S204). The process control goes to Step S203, and the image forming apparatus performs a print job based on the pattern-printed-sheet margin data acquired at Step S204 (Step S203).

Figure 21A:
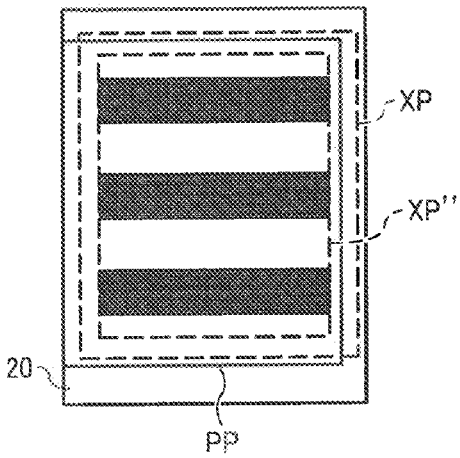
FIG. 21A is a schematic diagram showing a reduced print area of a sheet.
Figure 21B:
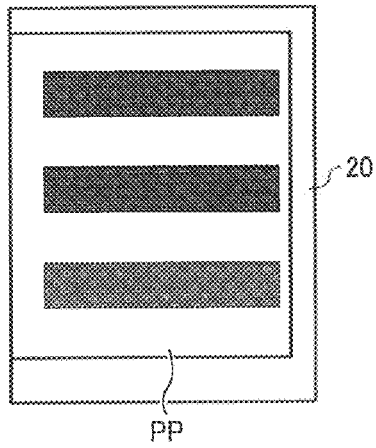
FIG. 21B is a schematic diagram showing a printed image that is printed on the sheet within the reduced print area shown in FIG. 21A.

In the above method, when a pattern-printed sheet is selected as a print sheet, right and left margins of the pattern-printed sheet are extended, and thereby preventing an image from running off to the conveying belt 20. Alternatively, an image can be reduced so as to be printed within a reduced print area XP". In this case also, it is possible to prevent the image from running off to the conveying belt 20. FIG. 21A is a schematic diagram showing the reduced print area XP". FIG. 21B is a schematic diagram showing a printed image that is printed on a sheet PP within the reduced print area XP".

To print an image on a pattern-printed sheet within such a reduced print area, a user needs to set a scale through the pattern-printed-sheet setting screen in advance.

Figure 22A:
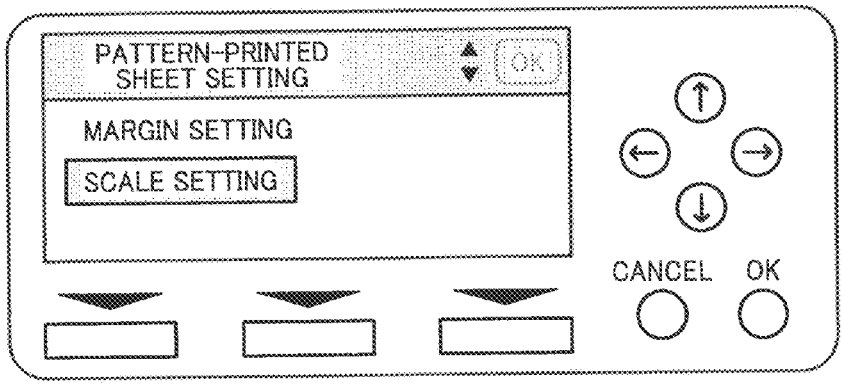
FIGS. 22A to 22C are schematic diagrams of an example of a pattern-printed-sheet scale setting screen displayed on the operation display unit.
Figure 22B:
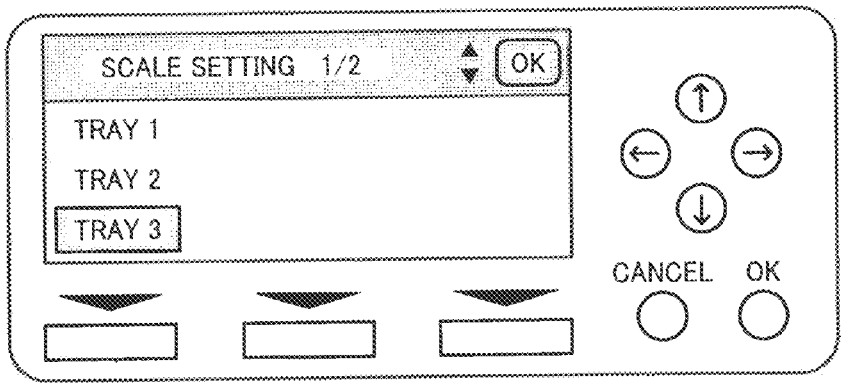
Figure 22C:
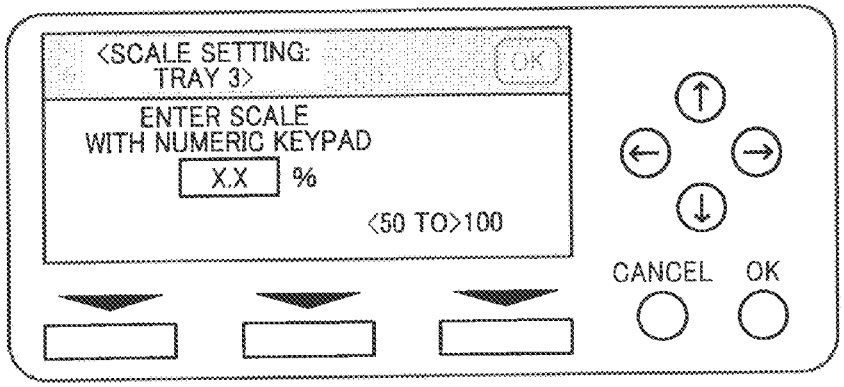

FIGS. 22A to 22C are schematic diagrams of an example of a pattern-printed-sheet scale setting screen displayed on the operation display unit 43. A user specifies a scale setting through a screen shown in FIG. 22A, and presses the "OK" button, so that a screen shown in FIG. 22B appears. The user specifies a tray 3 (in which pattern-printed sheets are contained) through the screen shown in FIG. 22B, and presses the "OK" button, so that a screen shown in FIG. 22C appears. The user enters a specific scale with the numeric keypad, so that the scale is set. Incidentally, as a travel distance of the conveying belt 20 increases, a degree of a misalignment of a sheet PP in the width direction on the conveying belt 20 due to a skew of the sheet PP is getting increased. Therefore, a scale of an image to be printed on the sheet PP is preferably set by each of the sheet feed trays 1, 7, and 12.

A scale set by a user is stored as pattern-printed-sheet scale data (by each of the trays) in a scale data table stored in the system memory 42.

Figure 23:
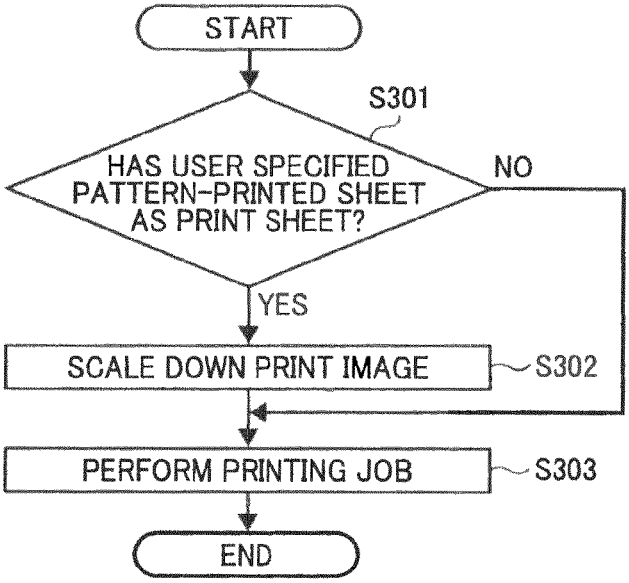
FIG. 23 is a flowchart of an example of a process performed by the image forming apparatus according to the first embodiment for setting a scale of a printed image.

FIG. 23 is a flowchart of an example of a process performed by the image forming apparatus for setting a scale of a printed image.

Whether a user has specified a pattern-printed sheet as a print sheet is checked (Step S301). When the user has specified a pattern-printed sheet as a print sheet (YES at Step S301), pattern-printed-sheet scale data is acquired from the scale data table stored in the system memory 42, and a printed image is scaled down (Step S302). The image forming apparatus prints the scaled image on the pattern-printed sheet (Step S303).

When the user has not specified a pattern-printed sheet as a print sheet, i.e., a print sheet is not a pattern-printed sheet (NO at Step S301), the process control goes to Step S303, and the image forming apparatus prints the image that is not scaled on the print sheet (Step S303).

To prevent a printed image from running off to the conveying belt 20, the method of extending right and left margins and the method of reducing a printed image are explained above. As another method, a print area can be set to be narrowed down.

When an image is printed on a pattern-printed sheet with any of the above methods, the detection of right and left end portions of the pattern-printed sheet is not performed. Therefore, if a user sets an incorrect sheet size by mistake, or if the sheet PP is conveyed askew, there is a possibility that the conveying belt 20 is stained with ink. If a subsequent print job is performed in a state where the conveying belt 20 is stained with ink, a subsequent sheet PP is stained with the ink attached to the conveying belt 20.

To avoid such a situation, after an image is printed on a pattern-printed sheet, the conveying belt 20 is cleaned so that even if the conveying belt 20 is stained with ink, it is possible to prevent a subsequent sheet PP from being stained with the ink.

Figure 24:
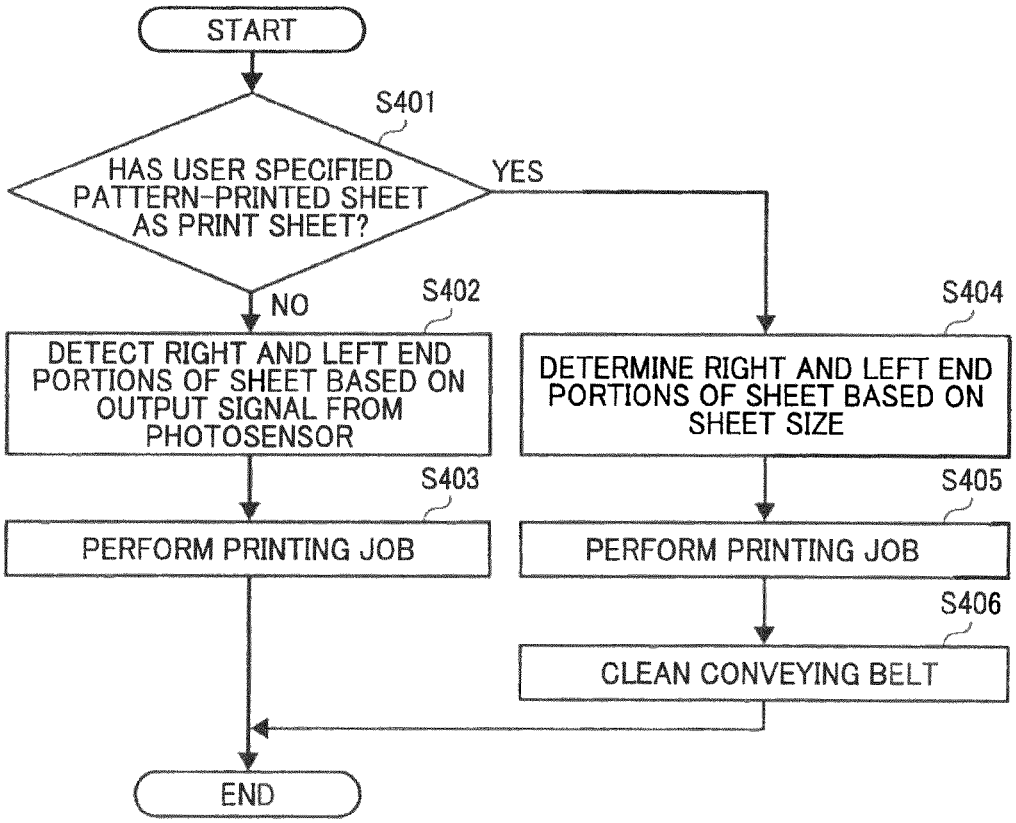
FIG. 24 is a flowchart of an example of a process, including a process of cleaning the conveying belt, performed by the image forming apparatus according to the first embodiment.

FIG. 24 is a flowchart of an example of a process, including a process of cleaning the conveying belt 20, performed by the image forming apparatus.

Whether a user has specified a pattern-printed sheet as a print sheet is checked (Step S401). When the user has not specified a pattern-printed sheet as a print sheet, i.e., a print sheet is not a pattern-printed sheet (NO at Step S401), right and left end portions of the print sheet are detected based on an output signal from the photosensor 31 (Step S402). The image forming apparatus performs a print job based on coordinates of the detected right and left end portions (Step S403).

When the user has specified a pattern-printed sheet as a print sheet (YES at Step S401), positions of right and left end portions of the pattern-printed sheet are determined by calculating coordinates of the right and left end portions based on sheet size data acquired from the sheet-size data table stored in the system memory 42 (Step S404). The forming apparatus performs a print job based on the coordinates of the right and left end portions obtained at Step S404 (Step S405). After that, the cleaning unit 28 cleans the surface of the conveying belt 20 (Step S406).

Such a process of cleaning the surface of the conveying belt 20 can be performed each time an image by each page has been printed on the pattern-printed sheet.

Figure 25:
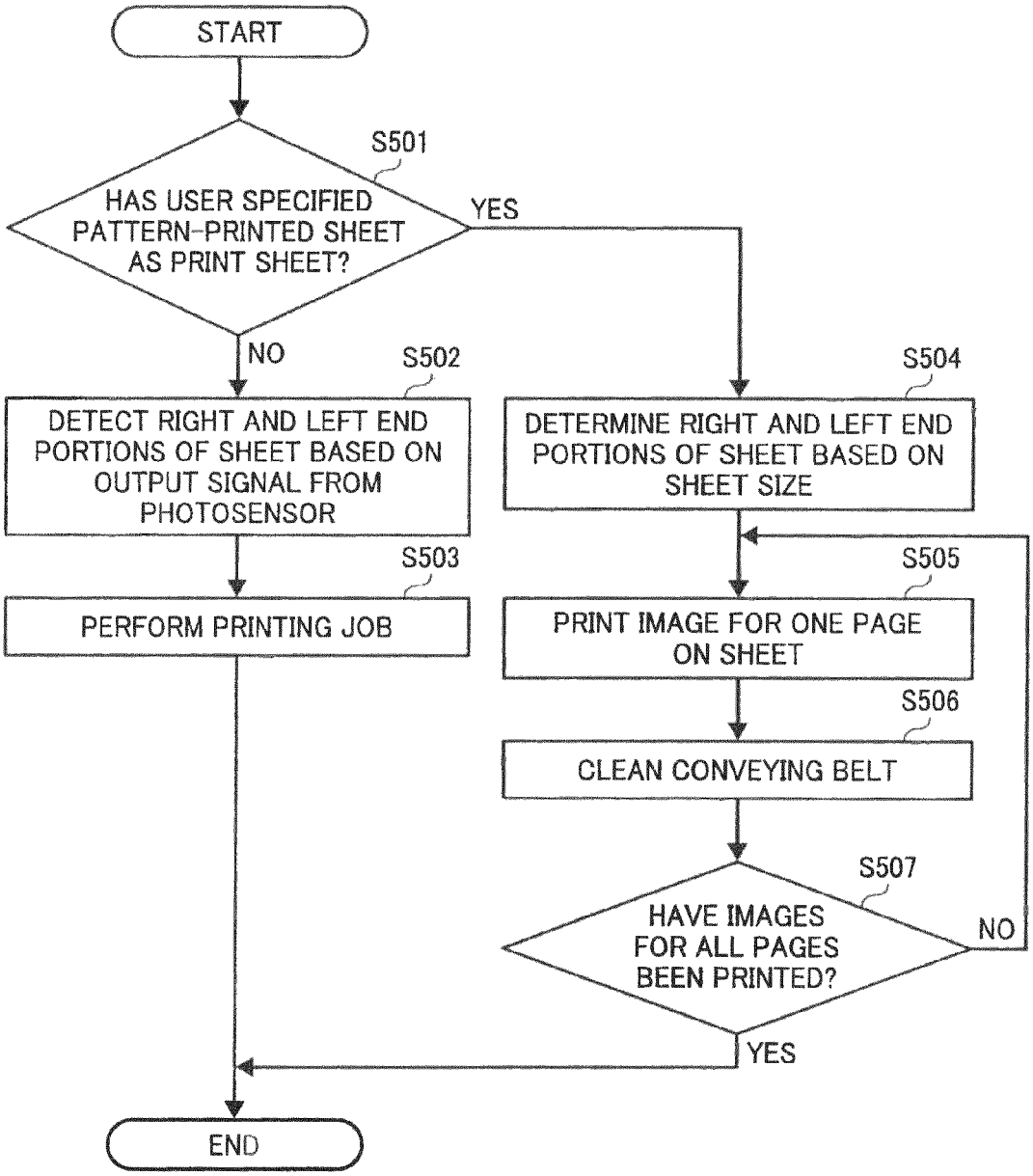
FIG. 25 is a flowchart of another example of the process shown in FIG. 24.

FIG. 25 is a flowchart of another example of the process, including the process of cleaning the conveying belt 20, performed by the image forming apparatus.

Whether a user has specified a pattern-printed sheet as a print sheet is checked (Step S501). When the user has not specified a pattern-printed sheet as a print sheet, i.e., a print sheet is not a pattern-printed sheet (NO at Step S501), right and left end portions of the print sheet are detected based on an output signal from the photosensor 31 (Step S502). The image forming apparatus performs a print job based on coordinates of the detected right and left end portions (Step S503).

When the user has specified a pattern-printed sheet as a print sheet (YES at Step S501), positions of right and left end portions of the pattern-printed sheet are determined by calculating coordinates of the right and left end portions based on sheet size data acquired from the sheet-size data table stored in the system memory 42 (Step S504). The forming apparatus prints an image for one page on the pattern-printed sheet based on the coordinates of the right and left end portions obtained at Step S504 (Step S505). After that, the cleaning unit 28 cleans the surface of the conveying belt 20 (Step S506).

Whether images for all the pages have been printed on pattern-printed sheets is checked (Step S507). When images for all the pages have not been printed on pattern-printed sheets (NO at Step S507), the process control returns to Step S505 until an image for the last page has been printed on the pattern-printed sheet. When images for all the pages have been printed on pattern-printed sheets (YES at Step S507), the process is terminated.

To reduce a time taken for printing the images for all the pages, the cleaning unit 28 can be configured to clean the surface of the conveying belt 20 upon completion of the print job, i.e., upon completion of printing the images for all the pages. In this case, whether the image for the last page has been printed on the pattern-printed sheet can be determined, for example, when there is no print request in a predetermined time period from when an image has been printed last.

Figure 26:
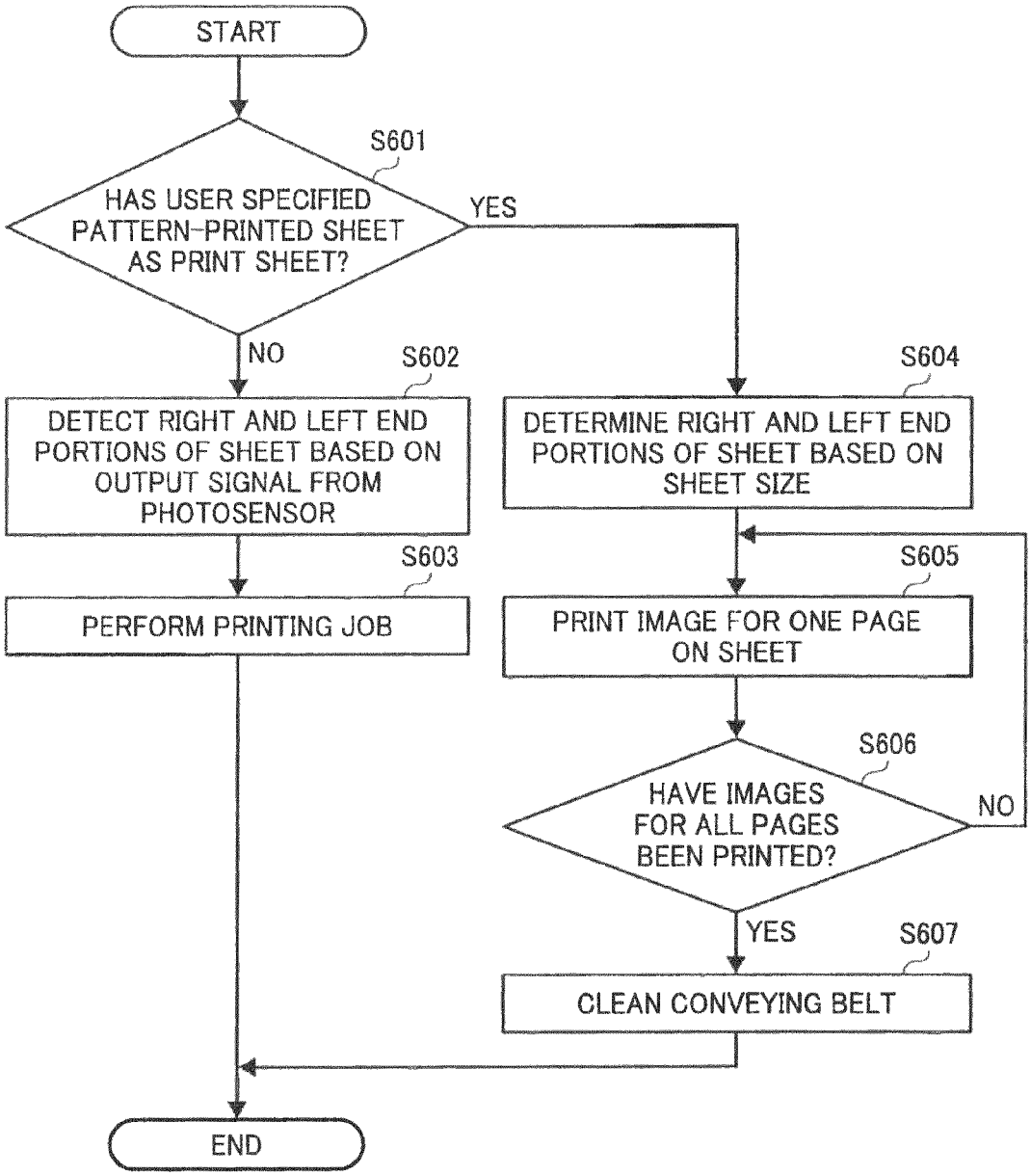
FIG. 26 is a flowchart of still another example of the process shown in FIG. 24.

FIG. 26 is a flowchart of still another example of the process, including the process of cleaning the conveying belt 20, performed by the image forming apparatus.

Whether a user has specified a pattern-printed sheet as a print sheet is checked (Step S601). When the user has not specified a pattern-printed sheet as a print sheet, i.e., a print sheet is not a pattern-printed sheet (NO at Step S601), right and left end portions of the print sheet are detected based on an output signal from the photosensor 31 (Step S602). The image forming apparatus performs a print job based on coordinates of the detected right and left end portions (Step S603).

When the user has specified a pattern-printed sheet as a print sheet (YES at Step S601), positions of right and left end portions of the pattern-printed sheet are determined by calculating coordinates of the right and left end portions based on sheet size data acquired from the sheet-size data table stored in the system memory 42 (Step S604). The forming apparatus prints an image for one page on the pattern-printed sheet based on the coordinates of the right and left end portions obtained at Step S604 (Step S605). Whether images for all the pages have been printed on pattern-printed sheets is checked (Step S606). When images for all the pages have not been printed on pattern-printed sheets (NO at Step S606), the process control returns to Step S605 until an image for the last page has been printed on the pattern-printed sheet.

When images for all the pages have been printed on pattern-printed sheets (YES at Step S606), the cleaning unit 28 cleans the surface of the conveying belt 20 (Step S607), and the process is terminated.

In this manner, in the image forming apparatus according to the first embodiment, when a pattern-printed sheet is selected as a print sheet, a print area is determined by obtaining coordinates of right and left end portions of the pattern-printed sheet based on sheet size data stored in advance. Therefore, the image forming apparatus can print an image on the pattern-printed sheet within the print area properly.

In the first embodiment, by determining positions of right and left end portions of a pattern-printed sheet accurately, the image forming apparatus can print an image on a specified area of the pattern-printed sheet properly. In a second embodiment, an image forming apparatus is configured to determine a position of a leading end portion of a pattern-printed sheet accurately, and thereby printing an image on a specified area of the pattern-printed sheet properly. Incidentally, it is assumed that the image forming apparatus according to the second embodiment has the same configuration as the image forming apparatus according to the first embodiment. The portions identical to those for the first embodiment are denoted with the same reference numerals, and the description of those portions is omitted.

As described in the first embodiment, a leading end portion of a sheet PP is detected based on an output signal from the photosensor 31. However, when an image is printed on a pattern-printed sheet in the same manner as in the case of the normal sheet, the photosensor 31 may sense a leading end portion of the pattern-printed sheet incorrectly, and thus the image forming apparatus may fail to print the image on the pattern-printed sheet within a specified print area.

Figure 27A:
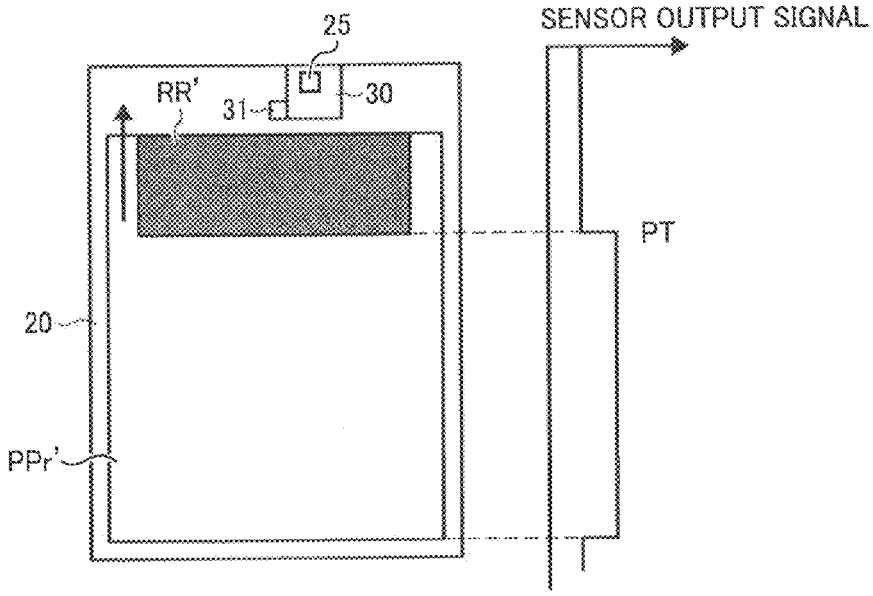
FIGS. 27A and 27B are schematic diagrams for explaining a cause of a false detection of a leading end portion of a sheet based on an output signal from the photosensor.
Figure 27B:
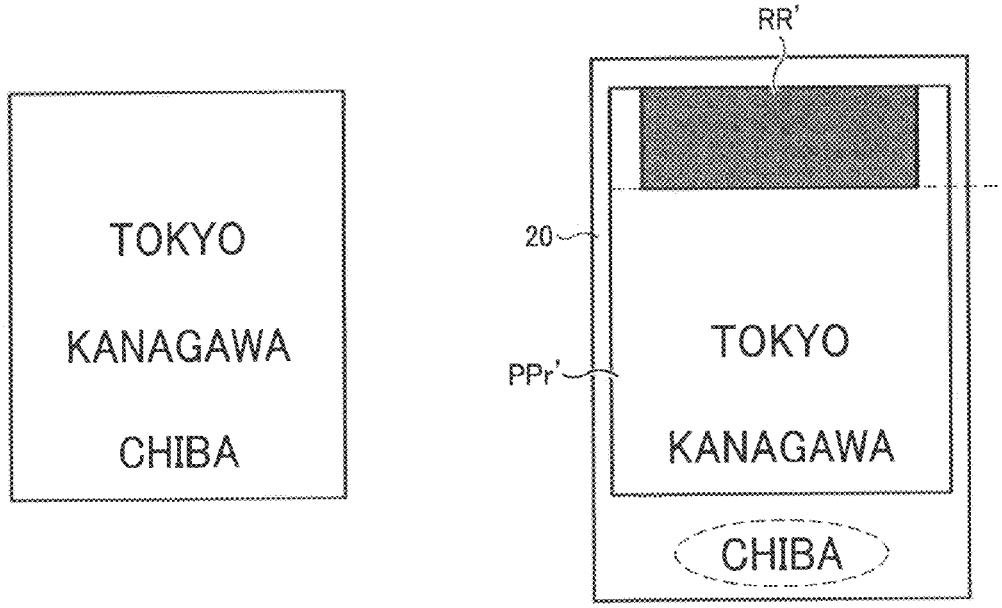

FIGS. 27A and 27B are schematic diagrams for explaining a cause of a false detection of a leading end portion of a pattern-printed sheet PPr' based on an output signal from the photosensor 31. For example, it is assumed that, as shown in FIG. 27A, the pattern-printed sheet PPr' has a printed pattern RR' on its leading end side of which within an area sensed by the photosensor 31. It may happen that a level of an output signal from the photosensor 31 becomes the low while reflective photosensor 31 senses the printed pattern RR'. In this case, the printed pattern RR' sensed by the photosensor 31 may be incorrectly determined as the conveying belt 20.

Just after the photosensor 31 passes by a trailing end of the printed pattern RR', a level of an output signal from the photosensor 31 becomes high, so that the trailing end is incorrectly determined as a leading end portion PT of the pattern-printed sheet PPr'.

As a result, for example, although an image shown on the left in FIG. 27B is to be printed, an image shown on the right in FIG. 27B is printed on the pattern-printed sheet PPr'. Namely, a lower portion of the image is printed on the conveying belt 20.

To avoid such a problem, a position of a leading end portion of a sheet PP is determined based on a travel distance of the sheet PP from the registration roller 5 because a distance between the registration roller 5 and the print head 25 is substantially constant in structure.

Specifically, first, the conveyance of the sheet PP is temporarily stopped in a state where the leading end portion of the sheet PP is struck on an entry point of an area where the sheet PP is conveyed by the conveying belt 20, i.e., the nip portion formed between the registration roller 5 and the conveying roller 21. This can be made in such a manner that after the sheet PP is conveyed for enough time to be conveyed for a distance between the sheet sensor 17 and the nip portion from when the sheet PP passes by the sheet sensor 17 located upstream of the nip portion, the conveyance of the sheet PP is stopped, so that the leading end portion of the sheet PP is struck on the nip portion. Incidentally, if the image forming apparatus includes a unit capable of measuring or presetting an amount of conveyance of the sheet PP, the conveyance of the sheet PP can be controlled based on not the conveying time but the amount of conveyance.

Then, the conveying belt 20 is driven to move for a travel distance corresponding to a distance from the nip portion to just under the photosensor 31. The distance depends on a layout for the conveyance, and is preliminarily written on the system. Whether the conveying belt 20 is driven to move for a target distance can be determined based on a driving amount that is monitored by reading an amount of change of the sub-scanning encoder 51*b* at regular intervals.

When the conveying belt 20 is driven to move for a travel distance corresponding to the distance from the nip portion to just under the photosensor 31, a sheet-conveyance software control to be performed upon detection of an ON state of the sensor is activated.

By such a control, even if a leading end portion of a pattern-printed sheet is not detected based on an output signal from the photosensor 31, the image forming apparatus can print an image on a specified area of the pattern-printed sheet with the same accuracy as in a case of a sheet other than the pattern-printed sheet.

Figure 28:
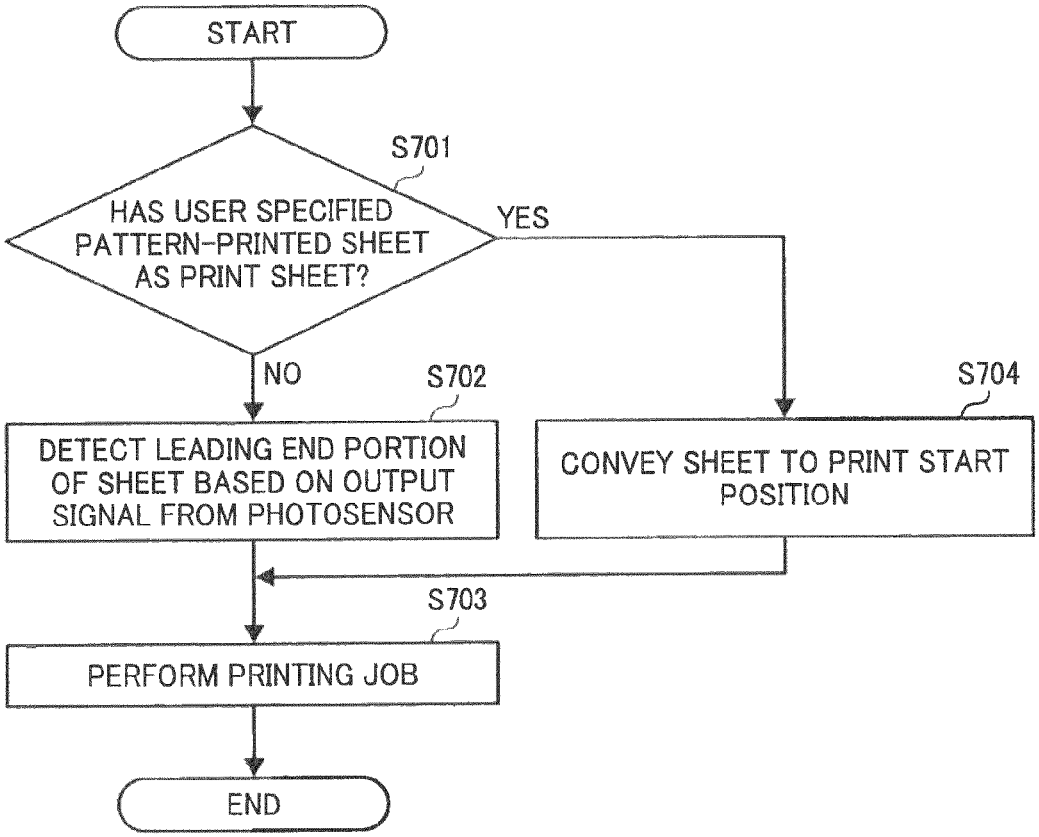
FIG. 28 is a flowchart of an example of a process performed by an image forming apparatus according to a second embodiment of the present invention for determining a print area of a pattern-printed sheet without detecting a leading end portion of the pattern-printed sheet.

FIG. 28 is a flowchart of an example of a process performed by the image forming apparatus according to the second embodiment for determining a print area of a pattern-printed sheet without detecting a leading end portion of the pattern-printed sheet.

Whether a user has specified a pattern-printed sheet as a print sheet is checked (Step S701). When the user has not specified a pattern-printed sheet as a print sheet, i.e., a print sheet is not a pattern-printed sheet (NO at Step S701), a leading end portion of the print sheet is detected based on an output signal from the photosensor 31 (Step S702). The image forming apparatus performs a print job at a timing when the leading end portion is detected (Step S703).

When the user has specified a pattern-printed sheet as a print sheet (YES at Step S701), the pattern-printed sheet is conveyed to a print start position by driving the conveying belt 20 to move for a travel distance corresponding to a distance from the registration roller 5 to just under the photosensor 31 (Step S704). After that, the process control goes to Step S703, and the image forming apparatus performs a print job.

While a leading end portion of a sheet PP is conveyed from the nip portion formed between the registration roller 5 and the conveying roller 21 to a predetermined position, a position error of the sheet PP may occur due to an operation error of the registration roller 5. Such a position error is referred to as a registration error. In general, an image forming apparatus has a function of adjusting the registration error.

Figure 29:
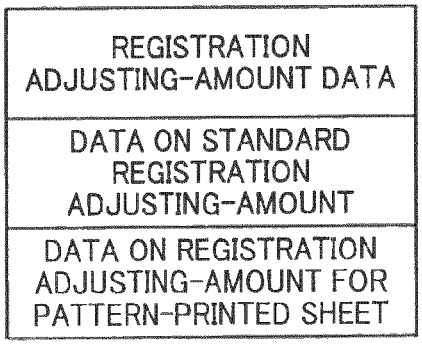
FIG. 29 is a schematic diagram of an example of a registration adjusting-amount data table.

An adjusting amount of a registration error is stored in a registration adjusting-amount data table. The registration adjusting-amount data table is stored in the system memory 42. FIG. 29 is a schematic diagram of an example of the registration adjusting-amount data table. In the example, the registration adjusting-amount data table includes registration adjusting-amount data, standard registration adjusting-amount data, and pattern-printed-sheet registration adjusting-amount data. The standard registration adjusting-amount data is data on a standard adjusting amount of registration. The standard registration adjusting-amount data is registered by, for example, a serviceman. On the other hand, the pattern-printed-sheet registration adjusting-amount data can be arbitrarily registered by a user. These registration adjusting-amount data is preferably set by each of the trays. Furthermore, as the pattern-printed-sheet registration adjusting-amount data, an offset value with respect to the standard registration adjusting-amount can be stored.

Figure 30A:
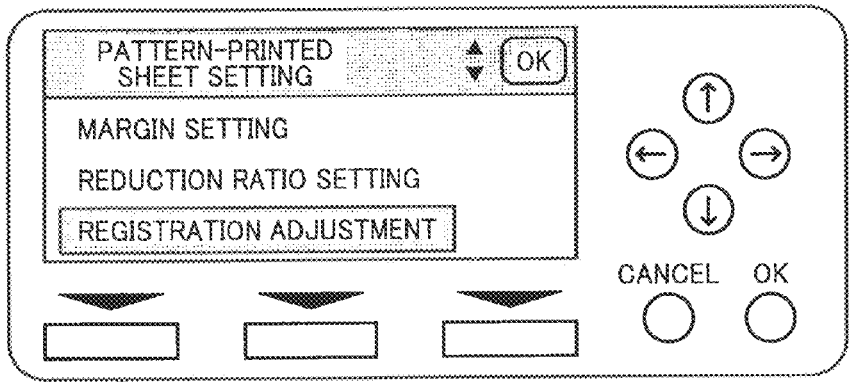
FIGS. 30A to 30C are schematic diagrams of an example of a pattern-printed-sheet registration adjusting-amount setting screen displayed on the operation display unit.
Figure 30B:
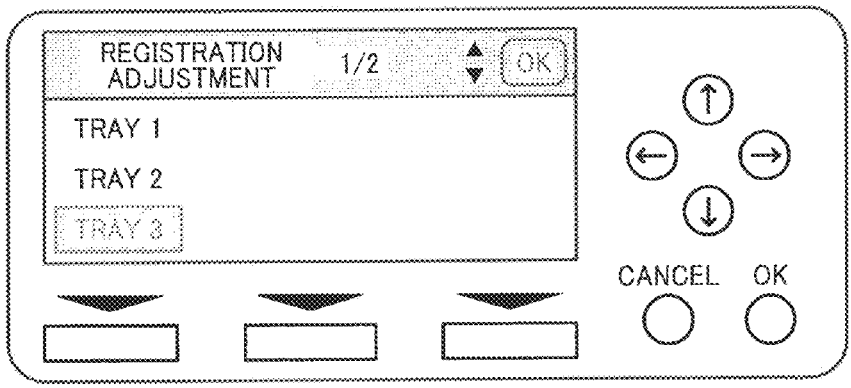
Figure 30C:
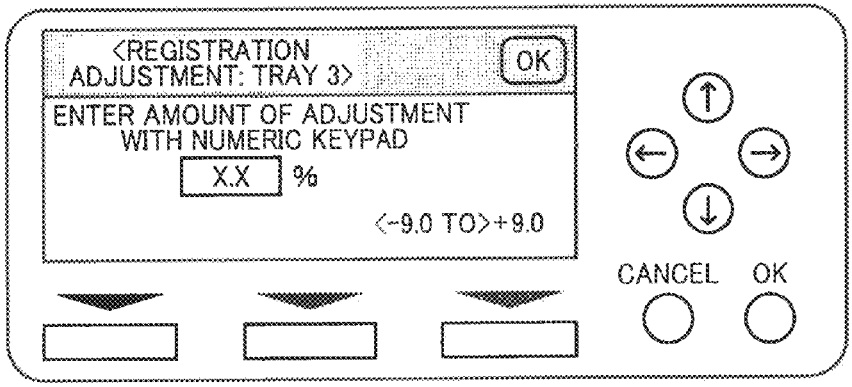

FIGS. 30A to 30C are schematic diagrams of an example of a pattern-printed-sheet registration adjusting-amount setting screen displayed on the operation display unit 43. A user specifies a registration adjusting-amount setting through a screen shown in FIG. 30A, and presses the "OK" button, so that a screen shown in FIG. 30B appears. The user selects a tray 3 (in which pattern-printed sheets are contained) through the screen shown in FIG. 30B, and presses the "OK" button, so that a screen shown in FIG. 30C appears. The user enters a specific registration adjusting-amount with the numeric keypad, so that the registration adjusting-amount is set.

A registration adjusting-amount set by a user is stored as pattern-printed-sheet registration adjusting-amount data (by each of the trays) in the registration adjusting-amount data table stored in the system memory 42.

Figure 31:
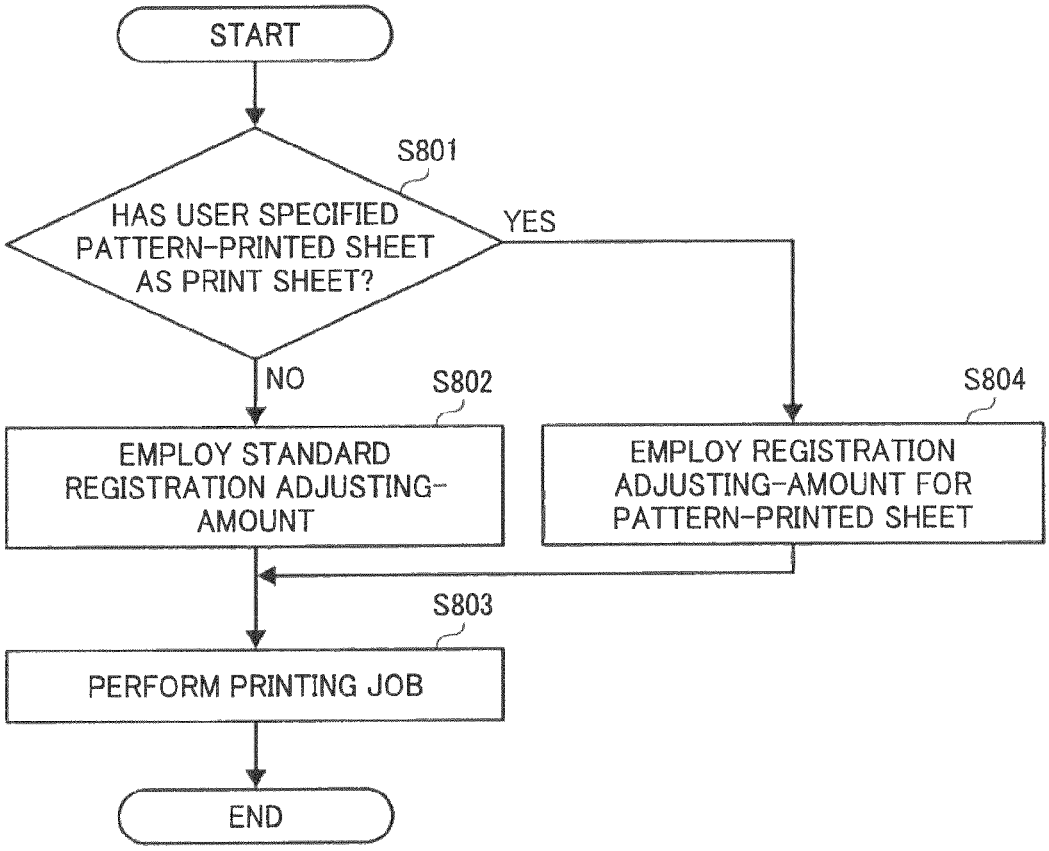
FIG. 31 is a flowchart of an example of a process performed by the image forming apparatus according to the second embodiment for setting a registration adjusting-amount.

FIG. 31 is a flowchart of an example of a process performed by the image forming apparatus for setting a registration adjusting-amount.

Whether a user has specified a pattern-printed sheet as a print sheet is checked (Step S801). When the user has not specified a pattern-printed sheet as a print sheet, i.e., a print sheet is not a pattern-printed sheet (NO at Step S801), the standard registration adjusting-amount is acquired from the registration adjusting-amount data table (Step S802). The image forming apparatus performs a print job based on the acquired registration adjusting-amount (Step S803).

When the user has specified a pattern-printed sheet as a print sheet (YES at Step S801), the pattern-printed-sheet registration adjusting-amount is acquired from the registration adjusting-amount data table (Step S804). The process control goes to Step S803, and the image forming apparatus performs a print job based on the acquired registration adjusting-amount.

By the use of the above method, it is possible to prevent the image forming apparatus from occurring such problems that a portion of an image is not printed on a sheet or the image is not printed on a specified area of the sheet because the image is not printed within a print area accurately.

Furthermore, the image forming apparatus can print an image on a sheet properly, i.e., it never happens that a portion of the image is printed on the conveying belt, so that it is possible to prevent the conveying belt from being stained with ink. Thus, it is possible to prevent an uplift behavior of the sheet from the conveying belt because the electrostatic force acting on the sheet is not reduced. Consequently, a surface of the sheet is not rubbed against the print head, so that it is possible to prevent an occurrence of such problems that a printed image is blurred or the print head is damaged.

A length of a sheet PP in the sub-scanning direction is normally measured not in the sheet feed tray but with a common sensor such as the sheet sensor 17 or a sensor (not shown) provided just posterior to the conveying roller block 4.

In the present embodiment, when an image is to be printed on a pattern-printed sheet, a leading end portion of the pattern-printed sheet is not detected. Therefore, in case a user sets a size of the pattern-printed sheet as a larger size than an actual size by mistake, depending on a layout, the printed image may be run off from the pattern-printed sheet, i.e., the conveying belt 20 may be stained with ink.

To avoid such a situation, when an image is to be printed on a pattern-printed sheet, each of the sheet sensors 6, 11, and 16 is switched so as to detect a length of the pattern-printed sheet in the sub-scanning direction. Therefore, even when a user sets a size of the pattern-printed sheet incorrectly, such a size error can be found at an early stage.

A length of a pattern-printed sheet can be obtained, for example, based on "a duration time in which the sheet is conveyed in a state where any of the sheet sensors 6, 11, and 16 that the pattern-printed sheet passes by first is turned ON" and "a speed of conveying the sheet". If a stepping motor is used for driving each of the pairs of the conveying rollers 3, 9, and 14, the length of the pattern-printed sheet can be calculated based on a driving amount of the stepping motor.

When a likelihood of a size error is detected, the system cancels the print job. As methods for cancelling the print job, there are such operations that "the conveyance of the sheet is stopped"; "the print job is cancelled even though the image is not fully printed on the sheet, and the sheet is discharged"; and "if the print job has been started (i.e., there is a possibility that the conveying belt 20 is stained with ink), the conveyance of the sheet is stopped", and if the print job has not been started yet (i.e., the conveying belt 20 is not stained with ink), the blank sheet on which the image is not printed is discharged".

Figure 32:
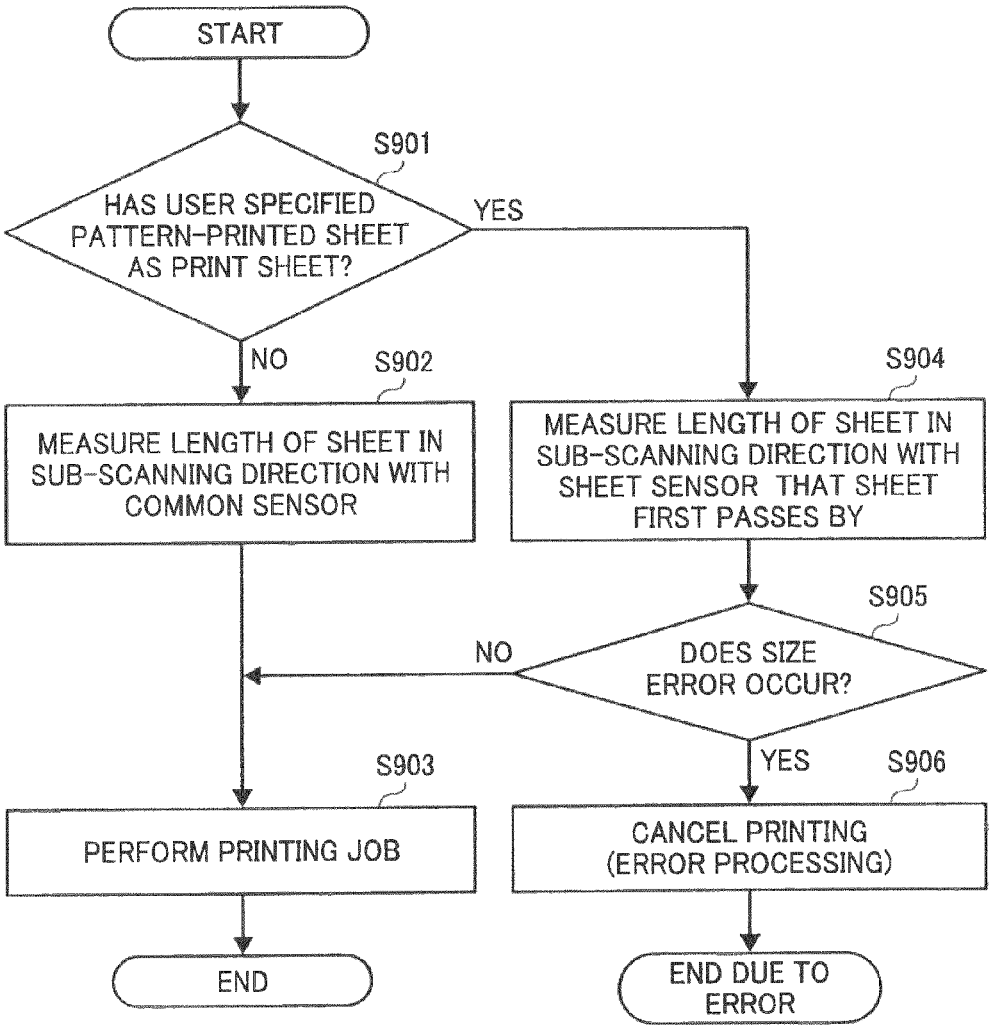
FIG. 32 is a flowchart of an example of a process performed by the image forming apparatus according to the second embodiment when a size error occurs.

FIG. 32 is a flowchart of an example of a process performed by the image forming apparatus when a size error occurs.

Whether a user has specified a pattern-printed sheet as a print sheet is checked (Step S901). When the user has not specified a pattern-printed sheet as a print sheet, i.e., a print sheet is not a pattern-printed sheet (NO at Step S901), the system measures a length of the sheet in the sub-scanning direction with the common sensor (Step S902). The image forming apparatus performs a print job based on the measured length of the sheet (Step S903).

When the user has specified a pattern-printed sheet as a print sheet (YES at Step S901), the system measures a length of the pattern-printed sheet in the sub-scanning direction with any of the sheet sensors 6, 11, and 16 that the pattern-printed sheet passes by first (Step S904). At this time, if an occurrence of a size error is detected (YES at Step S905), the image forming apparatus cancels performing a print job (Step S906).

If a size error does not occur (NO at Step S905), the process control goes to Step S903, and the image forming apparatus performs a print job based on the length of the sheet measured at Step S904.

In the above method, when an image is to be printed on a pattern-printed sheet, a leading end portion of the pattern-printed sheet is not detected. Therefore, when a size error is detected based on a length of the pattern-printed sheet in the sub-scanning direction, the image forming apparatus may start performing a print job depending on a size of the pattern-printed sheet. In this case, it is likely that a width of the pattern-printed sheet in the main scanning direction is also set incorrectly. Especially, when an actual width of the pattern-printed sheet in the main scanning direction is smaller than a set value, it is highly likely that the conveying belt 20 is stained with ink.

For example, although a user is actually supposed to set an A3 portrait as a size of a print sheet, when the user sets an A4 portrait by mistake, the image forming apparatus starts performing a print job before detecting that a length of the sheet in the sub-scanning direction is smaller than that for the A4 portrait. If the image extends over the entire width of the sheet in the main scanning direction, a printed image is run off from the sheet, i.e., the conveying belt 20 is stained with ink.

Therefore, when a size error is detected, the system recognizes that the conveying belt 20 needs to be cleaned, and stops the conveyance of the sheet as described above. Then, after a user removes the sheet from inside the system, the conveying belt 20 is cleaned. Or, after all sheets conveyed inside the system are discharged, the conveying belt 20 is cleaned.

Figure 33:
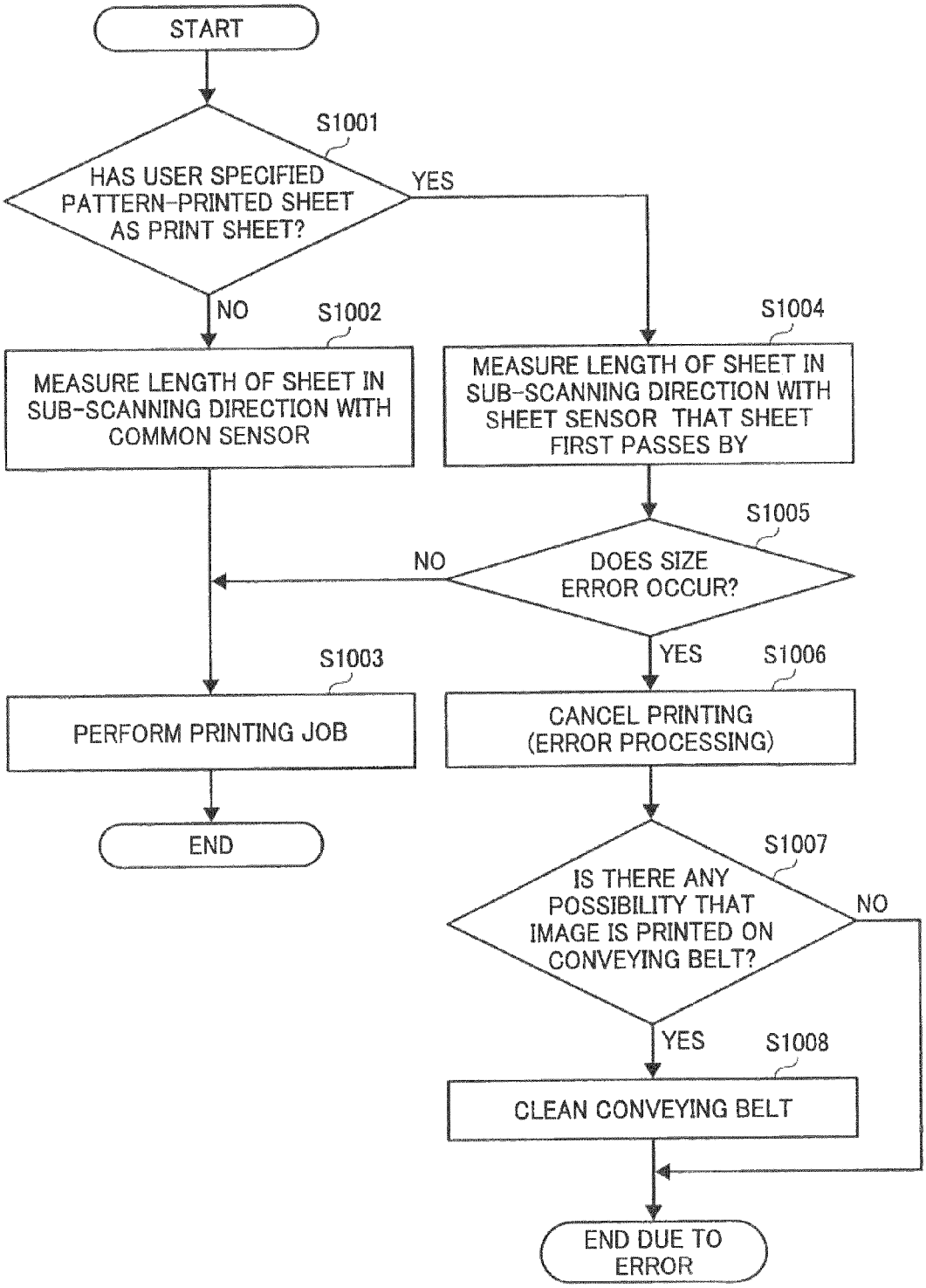
FIG. 33 is a flowchart of an example of a process, including the process of cleaning the conveying belt, performed by the image forming apparatus according to the second embodiment when a size error occurs.

FIG. 33 is a flowchart of an example of a process, including the process of cleaning the conveying belt 20, performed by the image forming apparatus when a size error occurs.

Whether a user has specified a pattern-printed sheet as a print sheet is checked (Step S1001). When the user has not specified a pattern-printed sheet as a print sheet, i.e., a print sheet is not a pattern-printed sheet (NO at Step S1001), the system measures a length of the print sheet in the sub-scanning direction with the common sensor (Step S1002). Then, the image forming apparatus performs a print job based on the measured length of the sheet (Step S1003).

When the user has specified a pattern-printed sheet as a print sheet (YES at Step S1001), the system measures a length of the pattern-printed sheet in the sub-scanning direction with any of the sheet sensors 6, 11, and 16 that the pattern-printed sheet passes by first (Step S1004). At this time, if an occurrence of a size error is detected (YES at Step S1005), the image forming apparatus cancels performing a print job (Step S1006).

Then, whether there is any possibility that an image is printed on the conveying belt 20, i.e., an actual width of the pattern-printed sheet in the main scanning direction is smaller than a set value is determined based on criteria as described above (Step S1007). When there is a possibility that an image is printed on the conveying belt 20 (YES at Step S1007), the cleaning unit 28 cleans the conveying belt 20 (Step S1008). On the other hand, when there is no possibility that an image is printed on the conveying belt 20 (NO at Step S1007), the process control skips Step S1008.

If a size error does not occur (NO at Step S1005), the process control goes to Step S1003, and the image forming apparatus performs a print job based on the length of the sheet measured at Step S1004.

In this manner, in the image forming apparatus according to the second embodiment, when a pattern-printed sheet is selected as a print sheet, after a position of a leading end portion of the pattern-printed sheet is detected based on a travel distance of the pattern-printed sheet conveyed on the conveying belt 20, an image is printed on the pattern-printed sheet. Therefore, it is possible to print the image on a specified area of the pattern-printed sheet properly.

Incidentally, in the first and second embodiments, a sheet PP is stuck on the surface of the conveying belt 20 by the use of an electrostatic force. Alternatively, microscopic holes can be made in the conveying belt 20 so that air is sucked through the holes by a suction fan, whereby a sheet PP can be stuck on the surface of the conveying belt 20 by the use of the suction power of the suction fan.

Furthermore, in the first and second embodiments, positions of right and left end portions of a sheet PP and positions of leading and trailing end portions of a sheet PP are detected with the photosensor. Alternatively, a charge-coupled device (CCD) can be used instead of the photosensor.

According to one aspect of the present invention, when a pattern-printed sheet is selected as a print sheet, a print area is determined by obtaining positions of right and left end portions of the pattern-printed sheet based on sheet size data stored in advance. Therefore, an image can be printed on the pattern-printed sheet within the print area properly.

Furthermore, according to another aspect of the present invention, when a pattern-printed sheet is selected as a print sheet, a position of a leading end portion of the pattern-printed sheet is determined based on a travel distance of the pattern-printed sheet conveyed on a conveying belt. Therefore, an image can be printed on a specified area of the pattern-printed sheet properly.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a conveying belt that conveys a sheet in a sub-scanning direction;

a sensor that reciprocates in a main scanning direction to detect lateral end portions of the sheet;

a print head that is mounted on a carriage reciprocating in the main scanning direction;

a sheet-information acquiring unit that acquires sheet information including a type and a size of the sheet;

a positional-information storing unit that stores therein positional information on lateral positions of the sheet on the conveying belt, corresponding to the size of the sheet; and a control unit that controls, when the type of the sheet is a pattern-printed sheet, a printing by the print head based on the positional information corresponding to the size of the sheet.

2. The image forming apparatus according to claim 1, wherein a reflectivity of a surface of the conveying belt on which the sheet is conveyed is lower than a reflectivity of the sheet.

3. The image forming apparatus according to claim 1, further comprising a margin storing unit that stores therein a margin of a printing area of the pattern-printed sheet, wherein the control unit further controls the printing based on the margin stored in the margin storing unit.

4. The image forming apparatus according to claim 1, further comprising a scale storing unit that stores therein a scale of a print area of the pattern-printed sheet, wherein the control unit further controls the printing based on the scale stored in the scale storing unit.

5. The image forming apparatus according to claim 1, wherein the sensor is mounted on the carriage.

6. The image forming apparatus according to claim 1, wherein the conveying belt conveys the sheet by sticking the sheet on its surface by an electrostatic force.

7. The image forming apparatus according to claim 1, wherein the sensor is a reflection-type photosensor.

8. The image forming apparatus according to claim 1, further comprising a cleaning unit that cleans the conveying belt.

9. An image forming method for an image forming apparatus including a positional-information storing unit that stores therein positional information on lateral positions of a sheet on a conveying belt corresponding to a size of the sheet, the image forming method comprising:

acquiring sheet information including a type and a size of the sheet;

conveying the sheet in a sub-scanning direction;

detecting lateral end portions of the sheet in a main scanning direction;

printing an image on the sheet; and controlling, when the type of the sheet is a pattern-printed sheet, the printing based on positional information corresponding to the size of the sheet.

* * * * *